US005473888A

United States Patent [19]

Douta et al.

[11] Patent Number: 5,473,888

[45] Date of Patent: Dec. 12, 1995

[54] AIR-FUEL RATIO CONTROL SYSTEM FOR INTERNAL COMBUSTION ENGINE

[75] Inventors: Hisayo Douta, Kariya; Masumi Kinugawa, Okazaki; Atsushi Suzuki, Oobu, all of Japan

[73] Assignee: Nippondenso Co., Ltd., Kariya, Japan

[21] Appl. No.: 261,282

[22] Filed: Jun. 15, 1994

Related U.S. Application Data

[62] Division of Ser. No. 949,689, Sep. 23, 1992, Pat. No. 5,343,701.

[30] Foreign Application Priority Data

| | | | |
|---|---|---|---|
| Sep. 24, 1991 | [JP] | Japan | 3-243499 |
| Feb. 21, 1992 | [JP] | Japan | 4-035397 |
| May 22, 1992 | [JP] | Japan | 4-131155 |

[51] Int. Cl.[6] ..... F02D 41/14

[52] U.S. Cl. ..... 60/276; 123/691; 123/694

[58] Field of Search ..... 123/488, 680, 123/682, 691, 693, 694; 60/276, 277, 285

[56] References Cited

U.S. PATENT DOCUMENTS

| | | | |
|---|---|---|---|
| 4,779,414 | 10/1988 | Nagai et al. | 60/274 |
| 4,917,067 | 4/1990 | Yoshida | 123/488 |
| 5,090,199 | 2/1992 | Ikuta et al. | 60/276 |
| 5,157,920 | 10/1992 | Nakaniwa | 60/276 |

FOREIGN PATENT DOCUMENTS

| | | |
|---|---|---|
| 0224195 | 6/1987 | European Pat. Off. . |
| 64-53038 | 3/1989 | Japan . |

OTHER PUBLICATIONS

Patent Abstracts of Japan, vol. 11, No. 76 (M–569) Mar. 7, 1987, Abstract of JP–A–61232350.

*Primary Examiner*—Tony M. Argenbright
*Attorney, Agent, or Firm*—Cushman, Darby & Cushman

[57] ABSTRACT

An air-fuel ratio control system for an internal combustion engine utilizes a pre-stored standard relation between an air-fuel ratio sensor signal and a standard air-fuel ratio indicative value for deriving the standard air-fuel ratio indicative value based on the sensor signal. The system further utilizes a pre-stored modified relationship between the standard air-fuel ratio indicative value and a for-control air-fuel ratio indicative value for deriving a for-control air-fuel ratio indicative value based on the derived standard air-fuel ratio indicative value. In the modified relationship, the for-control air-fuel ratio indicative value varies with respect to a corresponding variation of the standard air-fuel ratio indicative value within a given range across the standard air-fuel ratio indicative value representing a stoichiometric air-fuel ratio.

8 Claims, 26 Drawing Sheets

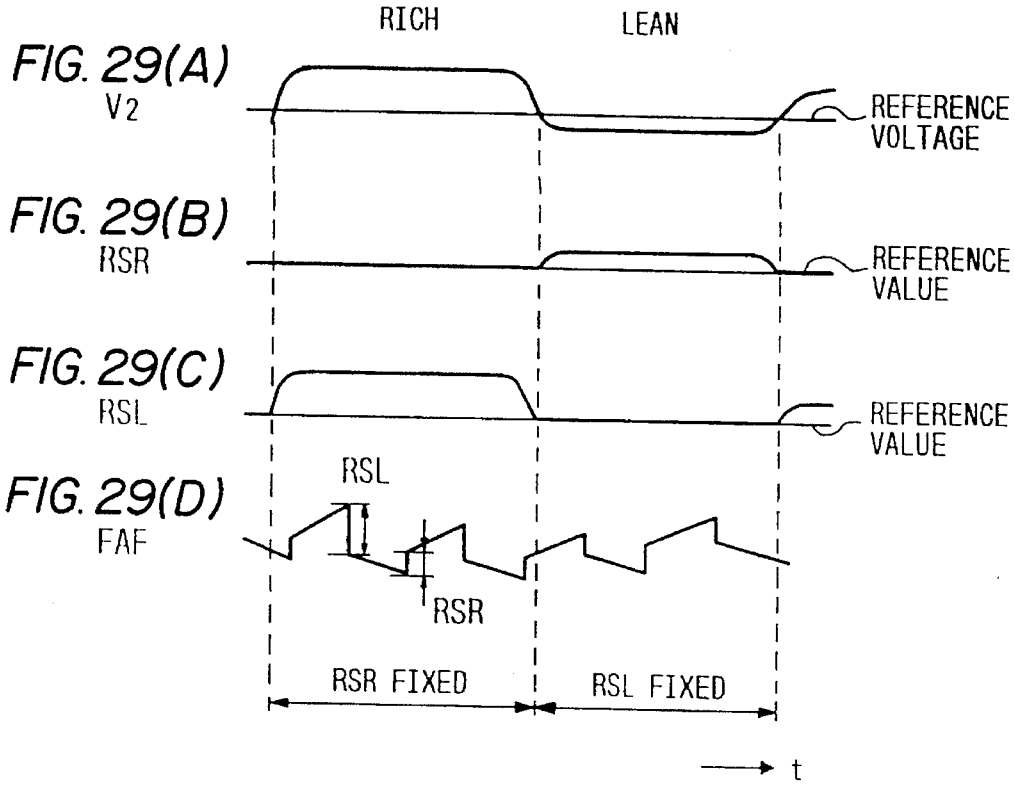
RICH
LEAN
FIG. 29(A)
V2
REFERENCE VOLTAGE
FIG. 29(B)
RSR
REFERENCE VALUE
FIG. 29(C)
RSL
REFERENCE VALUE
FIG. 29(D)
FAF
RSL
RSR
RSR FIXED
RSL FIXED
t
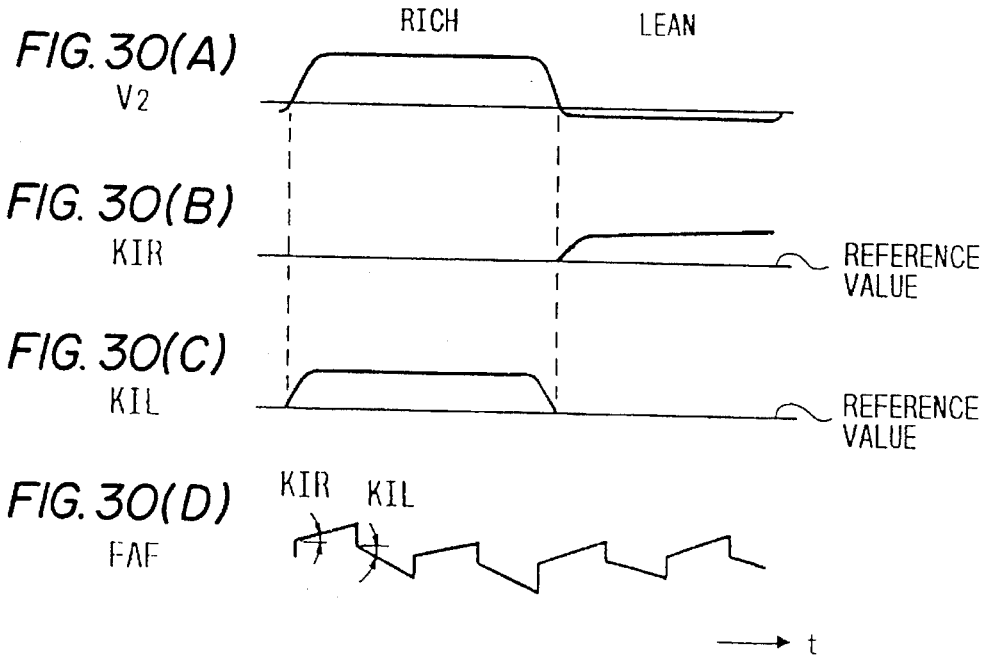
RICH
LEAN
FIG. 30(A)
V2
FIG. 30(B)
KIR
REFERENCE VALUE
FIG. 30(C)
KIL
REFERENCE VALUE
FIG. 30(D)
FAF
KIR
KIL
t

V2
RICH
LEAN

TDR

TDL

VOX

F1
R
L
1
0

FAF
TDL
TDR
t

AIR-FUEL RATIO CONTROL SYSTEM FOR INTERNAL COMBUSTION ENGINE

This is a division of application Ser. No. 07/949,689, filed Sep. 23, 1992, now U.S. Pat. No. 5,343,701.

BACKGROUND OF THE INVENTION

1. Field of the Invention

The present invention relates to an air-fuel ratio control system for an internal combustion engine. More specifically, the present invention relates to an air-fuel ratio feedback control system for an internal combustion engine which enables the center of the air-fuel ratio control to follow a target air-fuel ratio in an improved manner.

2. Description of the Prior Art

Conventionally, there has been proposed an air-fuel ratio control system for an internal combustion engine in which the air-fuel ratio control is performed by comparing an output signal of an oxygen sensor with a reference value representing a stoichiometric air-fuel ratio so as to determine whether a mixture gas is LEAN or RICH. In an air-fuel ratio control system of this type, a feedback correction coefficient rapidly changes when the monitored air-fuel ratio changes between LEAN and RICH. Furthermore, the feedback correction coefficient gradually changes by an integral action so as to maintain the monitored actual air-fuel ratio at the stoichiometric value. However, a problem with this type of air-fuel ratio control system is its poor follow-up characteristic for controlling the air-fuel ratio toward the stoichiometric value. This is particularly significant when a base of the air-fuel ratio control is deviated due to uneven individual characteristics of the fuel injectors so that the above-noted rapid change and integral action based control cannot follow such a deviation quickly.

In order to eliminate this problem, there has been proposed another type of the air-fuel ratio control system as disclosed in a Japanese First (unexamined) Patent Publication No. 1-121541 and U.S. Pat. No. 4,917,067, which is the equivalent of the former. In the system, the air-fuel ratio control is performed using a pre-stored characteristic which defines a substantially linear relation between an output signal of the oxygen sensor and a "for-control" air-fuel ratio. This pre-stored characteristic, the for-control air-fuel ratio, has a smooth correspondence to variations of the oxygen sensor output signal irrespective of whether it is close to or remote to a stoichiometric value. Accordingly, as the value of the oxygen sensor output signal is deviated from the stoichiometric air-fuel ratio, a value of the for-control air-fuel ratio is also deviated from the stoichiometric value. In this prior art system, since the for-control air-fuel ratio is derived from the oxygen sensor output signal using the above-noted pre-stored characteristic and the air-fuel ratio feedback control is performed based on a deviation between the for-control air-fuel ratio and a target air-fuel ratio, the follow-up controllability of the system is improved.

However, though the prior art air-fuel ratio control system improves the follow-up controllability as described above, there is another problem. An unexpected occurrence of shift or unevenness in the level of the oxygen sensor output signal which may be due to the individual characteristics of the employed oxygen sensor or due to inaccurately measuring temperatures or the like, regardless, the control performance of the system inevitably becomes unreliable. This adversely affects the exhaust emission and the follow-up controllability of the system. FIG. 12 shows this unevenness or shift of the oxygen sensor output. As seen in FIG. 12, the oxygen sensor output signal VOX is considered to be stable during a given air-fuel ratio range across the stoichiometric air-fuel ratio. On the other hand, the oxygen sensor output signal VOX is significantly unstable outside the given air-fuel ratio range. This instability causes the above-mentioned problem.

Further, the dynamic characteristic of the oxygen sensor at the time of inversion from RICH to LEAN differs from that at the time of inversion from LEAN to RICH. Generally, a response time of an oxygen sensor is longer to change its output voltage from RICH to LEAN than from LEAN to RICH. As a result, in the prior art system, the center of the air-fuel ratio control tends to be shifted to the LEAN side so that exhaust emission is deteriorated.

When an engine is idling, it is required that the control amplitude is small so as to provide idling stability. That is, engine speed variations should be set small. However, since the prior art system executes the same control when the engine is idling and when the engine is not idling, the control amplitude when the engine is idling becomes large and deteriorates the idling stability. In order to overcome this problem, in the foregoing prior art air-fuel ratio control system using the rapid change and integral action, the feedback correction coefficient is held fixed after the rapid change action to prevent reflection of the integral action onto the feedback correction coefficient so as to suppress the control amplitude. This, however, deteriorates the follow-up controllability of the system.

Further, due to the individual proper characteristic of each engine, the optimum center of the air-fuel ratio control, which can control the exhaust emission into the regulated range, differs for each engine. Accordingly, a particular means is necessary for shifting the control center to the optimum value required for each engine. In the prior art system, however, since no such a means is provided, the engine's individual characteristic cannot be dealt with.

Further, in the air-fuel ratio control, the required control characteristics differ at engine transitional conditions, such as immediate acceleration, a steady engine condition or during normal driving. Specifically, at an engine transitional condition, the target air-fuel ratio is largely deviated from the stoichiometric air-fuel ratio so that a quick follow-up of the control is required. On the other hand, at a steady engine condition, the actual air-fuel ratio should be stably maintained at the stoichiometric value without being adversely affected by the individual characteristics of the oxygen sensor. However, the prior art system performs the same control both at the engine transitional conditions and at engine steady conditions so that the system is unable to provide the air-fuel ratio control which matches the driving conditions of the engine.

SUMMARY OF THE INVENTION

Therefore, it is an object of the present invention to provide an improved air-fuel ratio control system for an internal combustion engine that can eliminate the above-noted defects inherent in the prior art.

To accomplish the above-mentioned and other objects, according to one aspect of the present invention, an air-fuel ratio control system for an internal combustion engine comprises a first sensor for monitoring a preselected component contained in an exhaust gas to produce an air-fuel ratio indicative signal, first storing means for pre-storing a standard relation between the first sensor signal and a standard air-fuel ratio indicative value, first deriving means responsive to the first sensor signal to derive the standard air-fuel ratio indicative value according to the pre-stored standard relation, second storing means for pre-storing a first modified relation between the standard air-fuel ratio indicative value and a for-control air-fuel ratio indicative value, the first modified relation defining the for-control air-fuel ratio indicative value to vary corresponding to a variation of the standard air-fuel ratio indicative value within a given range across the standard air-fuel ratio indicative value representing a stoichiometric air-fuel ratio, while, defining the for-control air-fuel ratio indicative value to be held constant outside the given range, second deriving means responsive to the standard air-fuel ratio indicative value derived by the first deriving means to derive the for-control air-fuel ratio indicative value according to the first modified relation, third deriving means for deriving a deviation between the for-control air-fuel ratio indicative value derived by the second deriving means and a target air-fuel ratio indicative value, and controller means for performing a feedback control of an air-fuel ratio of a mixture gas to be fed into an engine cylinder, the controller means performing the feedback control based on the deviation derived by the third deriving means.

According to another aspect of the present invention, an air-fuel ratio control system for an internal combustion engine comprising a first sensor provided upstream of a catalytic converter for monitoring a preselected component contained in an exhaust gas upstream of the catalytic converter to produce an air-fuel ratio indicative signal, a second sensor provided downstream of the catalytic converter for monitoring a preselected component contained in the exhaust gas downstream of the catalytic converter to produce an air-fuel ratio indicative signal, detection means for comparing the first sensor signal with a reference value to determine whether an air-fuel ratio of a mixture gas to be fed into an engine cylinder is RICH or LEAN relative to a target air-fuel ratio, control means for performing a feedback control of the air-fuel ratio based on a feedback control constant and the determination of RICH or LEAN by the detection means, deriving means for deriving a correction amount based on a deviation of the second sensor signal relative to a target air-fuel ratio indicative value, and correction means for correcting the feedback control constant based on the derived correction amount.

According to still another aspect of the present invention, an air-fuel ratio control system for an internal combustion engine comprising a first sensor provided upstream of a catalytic converter for monitoring a preselected component contained in an exhaust gas upstream of the catalytic converter to produce an air-fuel ratio indicative signal, a second sensor provided downstream of the catalytic converter for monitoring a preselected component contained in the exhaust gas downstream of the catalytic converter to produce an air-fuel ratio indicative signal, storing means for storing a feedback control constant, deriving means for deriving a correction amount based on a value of the second sensor signal, correction means for correcting the feedback control constant based on the derived correction amount, and control means for performing a feedback control of an air-fuel ratio of a mixture of gas to be fed into an engine cylinder based on the corrected feedback control constant and the first sensor signal.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings:

FIG. 29 is a timing chart showing time-domain relation between the output of the downstream oxygen sensor, rapid change amounts and a feedback air-fuel ratio dependent correction coefficient;

FIG. 30 is a timing chart showing time-domain relation between the output of the downstream oxygen sensor, integral constants and the feedback air-fuel ratio dependent correction coefficient;

DESCRIPTION OF THE PREFERRED EMBODIMENT

Figure 1:
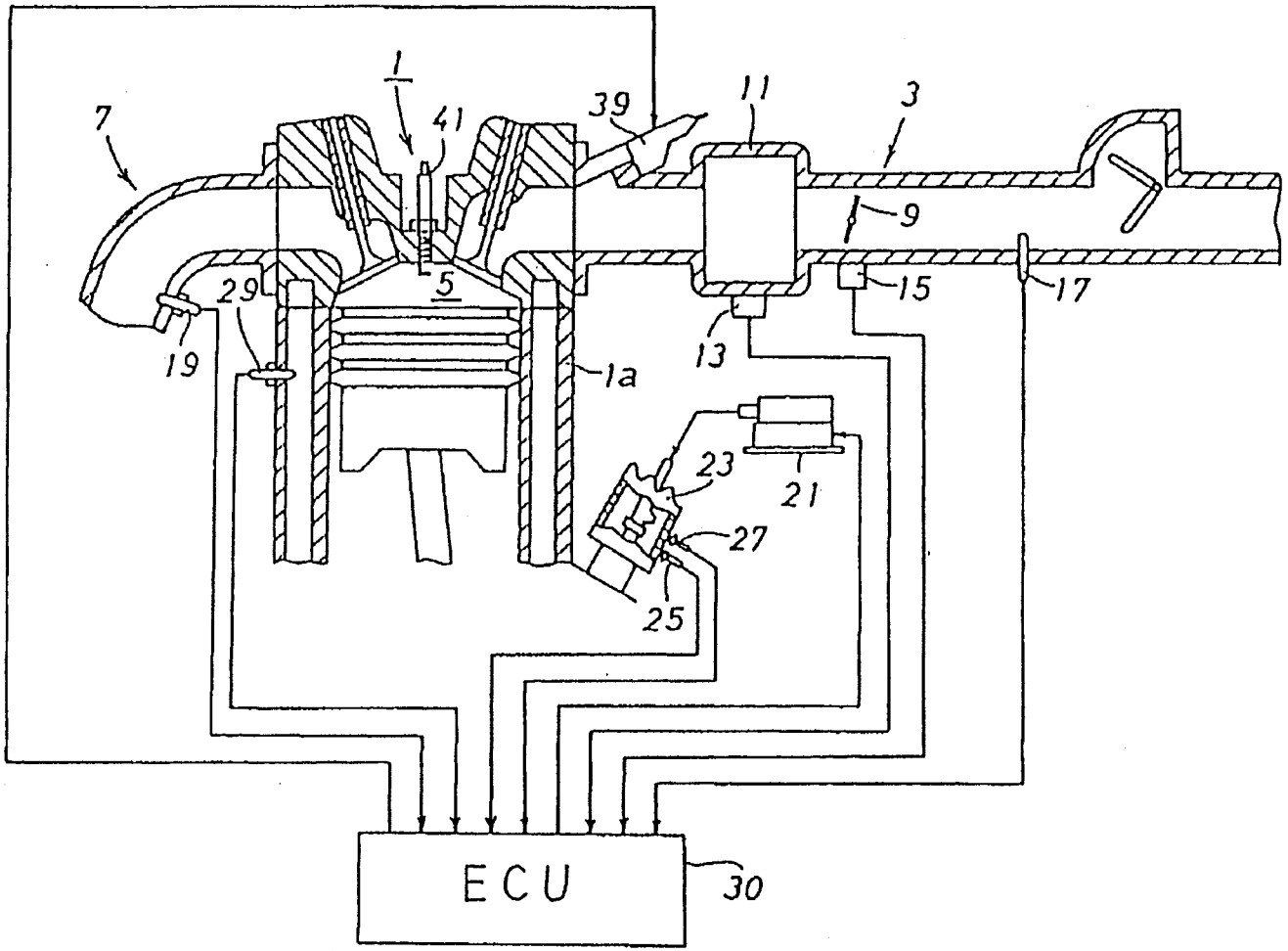
FIG. 1 is a sectional view showing a schematic structure of an internal combustion engine.

Referring now to the drawings, an air-fuel ratio control system for a vehicular internal combustion engine according to a first preferred embodiment of the present invention will be described with reference to FIGS. 1 to 12.

Figure 2:
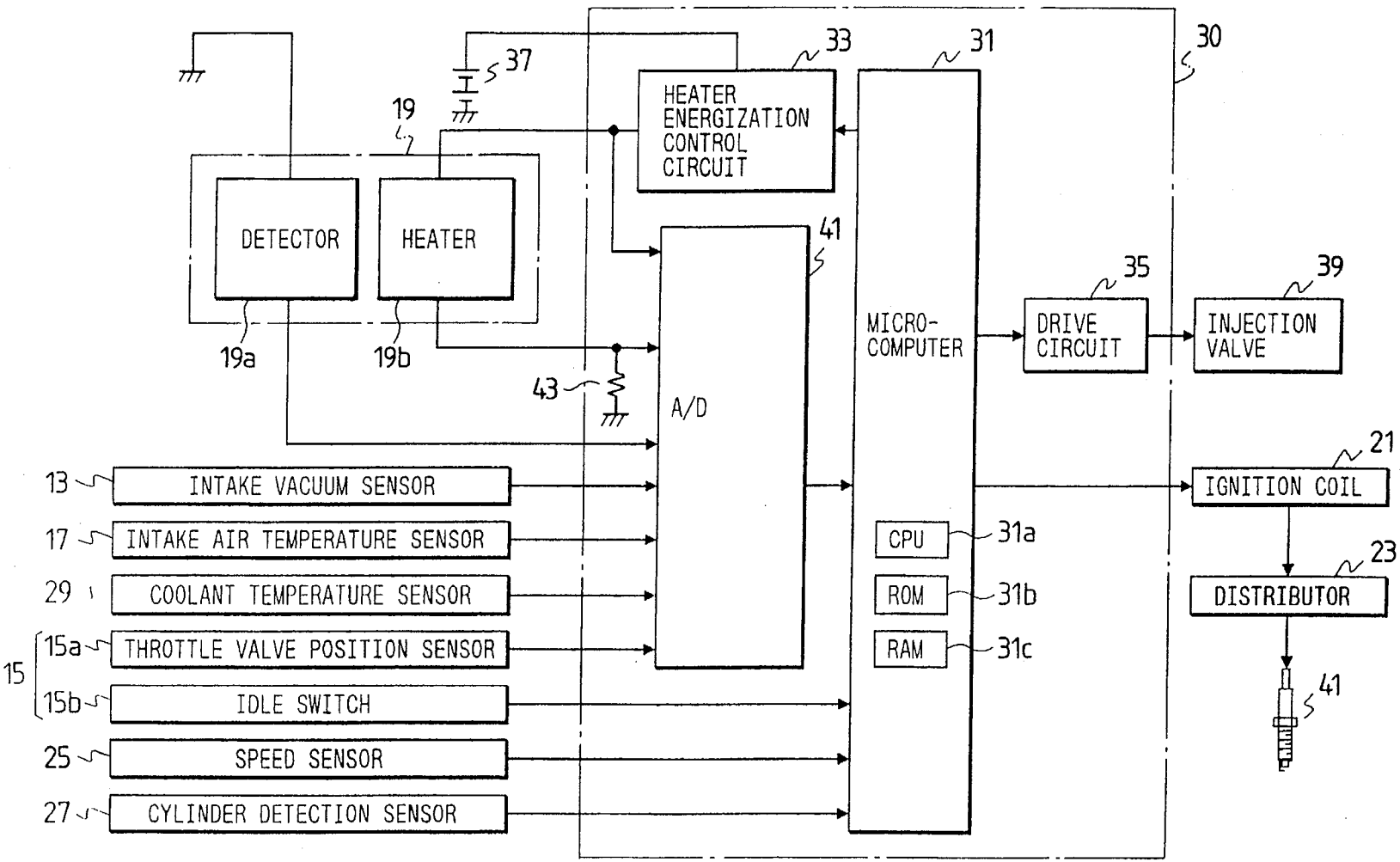
FIG. 2 is a block diagram showing a structure of a control unit and its peripheral devices.

FIG. 1 schematically shows the engine 1 and FIG. 2 is a block diagram showing an electronic control unit (ECU) 30 along with its peripheral input and output devices.

The engine 1 includes an induction system 3, a combustion chamber 5 and an exhaust system 7.

The induction system 3 includes, as known elements, an air cleaner (not shown), a throttle valve 9, a surge tank 11, an intake air pressure sensor or an intake vacuum sensor 13, a throttle position sensor 15 and an intake air temperature sensor 17 etc. The intake vacuum sensor 13 is disposed in the surge tank 11 to monitor an intake vacuum. The throttle position sensor 15 includes a throttle opening degree sensor 15*a* and an idle switch 15*b*. The idle switch 15*b* turns on at the engine idling.

The exhaust system 7 includes, as known elements, an oxygen sensor or an $O_2$ sensor 19, an ignition coil 21, a distributor 23, an engine speed sensor 25, a cylinder detection sensor 27, an engine coolant temperature sensor 29 etc. The oxygen sensor 19 is of an electromotive-force-type and detects oxygen concentration in the exhaust gas. The oxygen sensor 19 can indicate a sudden change in oxygen concentration output across the stoichiometric air-fuel ratio. The engine speed sensor 25 produces the number of pulses in proportion to an engine speed NE. The engine coolant temperature sensor 29 is mounted to a cylinder block la and detects a temperature of the engine coolant or the engine cooling water, which is circulated to cool the engine cylinder block 1*a*.

Signals from the above-referred sensors indicate various engine operating conditions which are fed into the ECU 30.

The ECU 30 includes, as a main component, a microcomputer 31 having a CPU 31*a*, a ROM 31*b* and a RAM 31*c* etc. The microcomputer 31 is connected at its input/output port to the idle switch 15*b*, the engine speed sensor 25, the cylinder detection sensor 27, the ignition coil 21, a heater energization control circuit 33 and a drive circuit 35 etc. The ignition coil 21 is connected to the distributer 23, which is in turn connected to an ignition plug 41. The heater energization control circuit 33 controls electric power from a battery 37 to a heater 19*b* of the oxygen sensor 19. When the heater 19*b* is energized, a detection element 19*a* of the oxygen sensor 19 is heated. The drive circuit 35 is for actuating a fuel injection valve 39.

The input/output port of the microcomputer 31 is connected via an analog-to-digital converter (A/D converter) 42 to the intake vacuum sensor 13, the throttle opening degree sensor 15*a*, the intake air temperature sensor 17 and the engine coolant temperature sensor 29 etc., which respectively produce analog signals. The A/D converter 42 receives further input from an output of the heater energization control circuit 33, a terminal voltage of a current detection resistor 43 and an output of the detection element 19*a* of the oxygen sensor 19.

The ECU 30 detects the operating conditions of the engine 1 based on the outputs from the above-described sensors and the heater energization control circuit 33 etc. and controls the operation of the engine 1.

Figure 3:
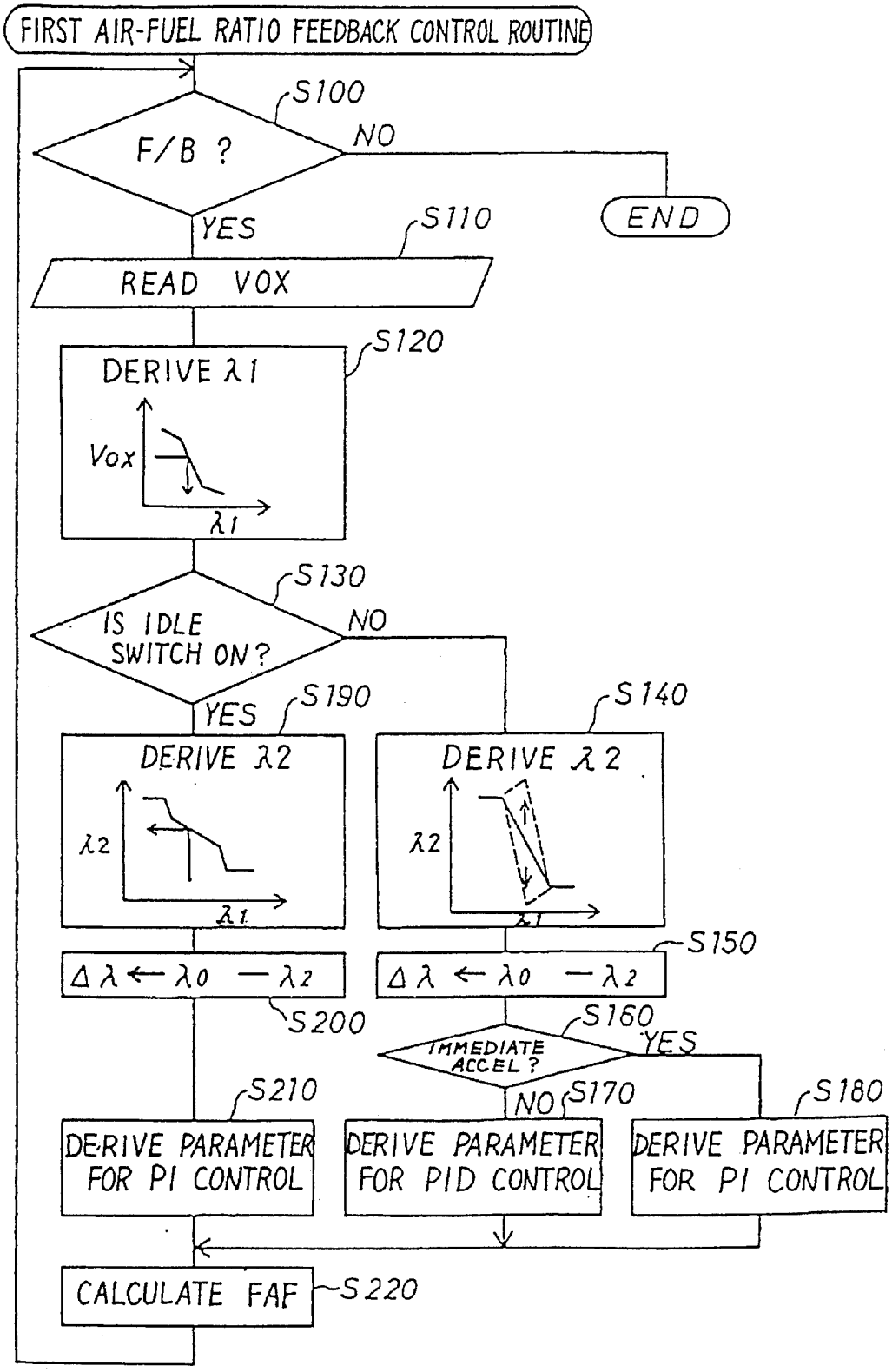
FIG. 3 is a flowchart of a first air-fuel ratio feedback control routine according to a first preferred embodiment of the present invention.
Figure 4:
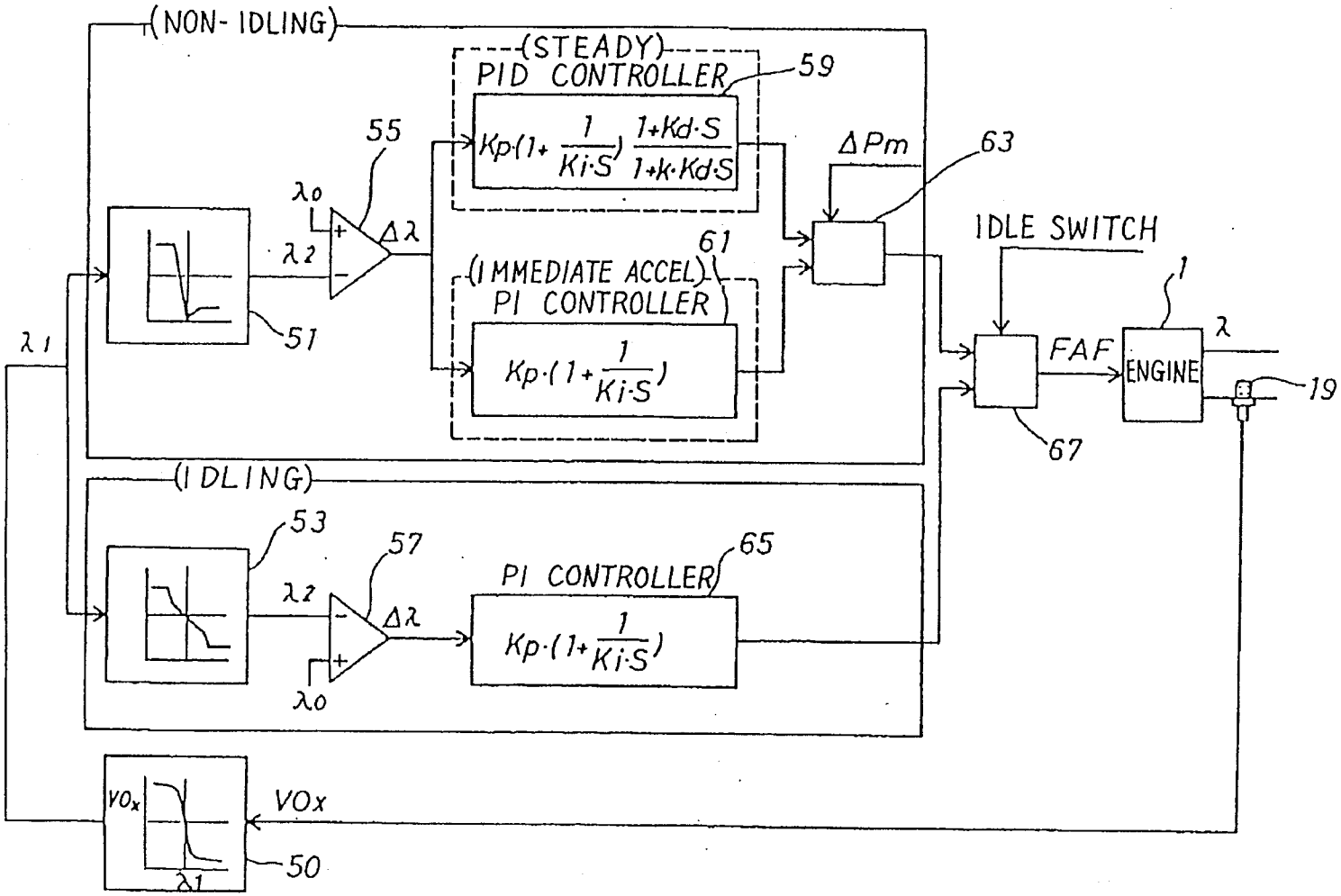
FIG. 4 is a block diagram for explaining the air-fuel ratio feedback control executed by the flowchart of FIG. 3.

FIG. 3 shows a flowchart of a first air-fuel ratio feedback control routine, and FIG. 4 shows a block diagram for explaining the air-fuel ratio feedback control executed based on the flowchart in FIG. 3 in detail.

The first air-fuel ratio feedback control routine, as shown in FIG. 3, is executed by the CPU 31*a* of the ECU 30 as a timer interrupt every 20 msec.

A first step 100 determines whether a given condition for the air-fuel ratio feedback control is established. This determination is made based on, for example, engine coolant temperature data, fuel cut-off data and acceleration enrichment data. If answer at the step 100 is NO, i.e. the given condition is not established, then the routine goes to END to be terminated for a subsequent cycle of the interrupt routine.

On the other hand, if answer at the step 100 is YES, then the routine goes to a step 110, which reads out an output voltage VOX from the oxygen sensor 19. At a subsequent step 120, a standard excess air ratio $^{\lambda}1$ is derived based on the output voltage VOX read out at the step 110. The excess air ratio represents a rate of an actual air amount included in the mixture gas relative to a stoichiometric air amount in a gas mixture having an air-fuel ratio. Accordingly, the excess air ratio at the time of the stoichiometric air-fuel ratio is set to 1.0. The standard excess air ratio $^{\lambda}1$ is a value derived by estimating an air amount included in the monitored actual mixture gas based on the output voltage VOX which is indicative of an oxygen concentration in the exhaust gas or in the exhaust passage.

Subsequently, step 130 determines whether the idle switch is ON, i.e. whether the engine 1 is in an idling condition. If the answer at the step 130 is NO, i.e. the idle switch if OFF, the routine goes to a step 140. At the step 140, a for-control excess air ratio $^{\lambda}2$, which corresponds to the standard excess air ratio $\lambda 1$ derived at the step 120, is derived using a characteristic map for non-idling engine. At a subsequent step 150, the for-control excess air ratio $\lambda 2$ is derived at the step 140 is subtracted from a target excess air ratio $\lambda 0$ to derive and set a deviation $\Delta\lambda$. The target excess air ratio $\lambda 0$ represents an excess air ratio in the mixture of gas of a target air-fuel ratio which is determined depending on the operating condition of the engine. For example, when the target air-fuel ratio is the stoichiometric air-fuel ratio, the target excess air ratio $\lambda 0$ is 1.0.

Subsequently, a step 160 determines whether the vehicle is under an immediate acceleration. If the answer at the step 160 is NO, i.e. the vehicle is not under the immediate acceleration, the routine goes to a step 170 where calculation parameters for a PID (proportional, integral and differential actions) control are derived. On the other hand, if the answer at the step 160 is YES, i.e. the vehicle is under the immediate acceleration, the routine goes to a step 180 where calculation parameters for a PI (proportional and integral actions) control are derived.

Referring back to the step 130, if the answer at the step 130 is YES, i.e. the idle switch **15*b* is ON, i.e. the engine is idling, then the routine goes to step 190. At step 190, a for-control excess air ratio $\lambda 2$, which corresponds to the standard excess air ratio $\lambda 1$ derived at the step 120, is derived using a characteristic map for the engine idling. Subsequently, at step 200, the for-control excess air ratio $\lambda 2$ is subtracted from a target excess air ratio $\lambda 0$ to derive and set a deviation $\Delta\lambda$. At a subsequent step 210**, calculation parameters for a PI (proportional and integral actions) control are derived.

Finally, from one of the steps 170, 180 and 210, the routine goes to step 220. At step 220, a feedback air-fuel ratio dependent correction coefficient FAF is calculated, which will be described later in detail. When the step 220 is processed, the current cycle of the first air-fuel ratio feedback control routine is terminated.

Based on the calculated FAF, the air-fuel ratio feedback control is performed in a known manner.

Now, the air-fuel ratio feedback control performed by the flowchart of FIG. 3 will be described in detail with reference to the block diagram of FIG. 4 which is equivalent to the control routine of FIG. 3.

Figure 5:
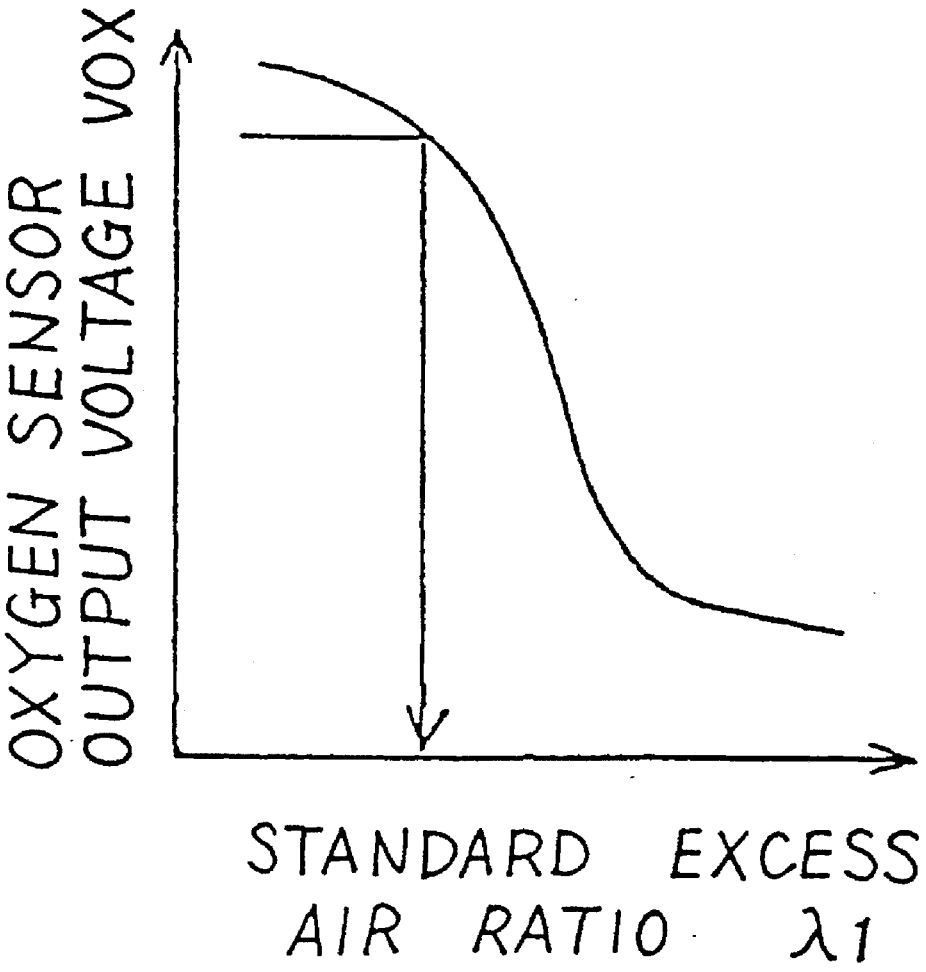
FIG. 5 is a characteristic map showing a relation between an output voltage of an oxygen sensor and a standard excess air ratio.
Figure 6:
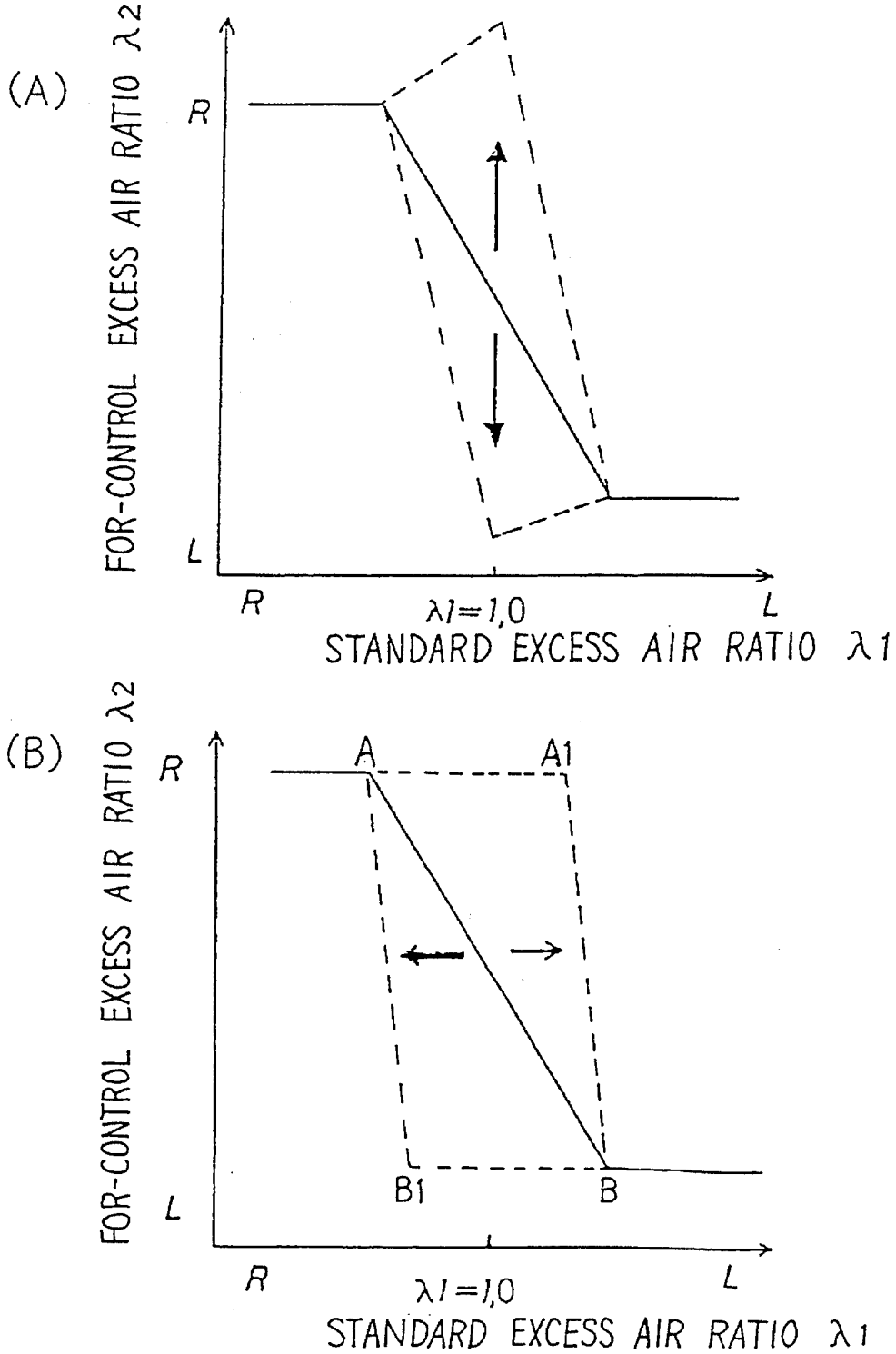
FIG. 6 contains characteristic maps showing relationships between the standard excess air ratio and a for-control excess air ratio at a engine non-idling.

The output voltage VOX of the oxygen sensor 19 is input to a linearizer 50, which correspond to steps 110 and 120 in FIG. 3. The linearizer 50 has a characteristic map as shown in FIG. 5. In practice, the data identified by this characteristic map is pre-stored in the ROM **31*b*. This characteristic map defines a relation between the output voltage VOX of the oxygen sensor 19 and the standard excess air ratio $\lambda 1$. Accordingly to this characteristic map, the linearizer 50 derives the standard excess air ratio $\lambda 1$, which corresponds to the output voltage VOX received from the oxygen sensor 19**.

Figure 7:
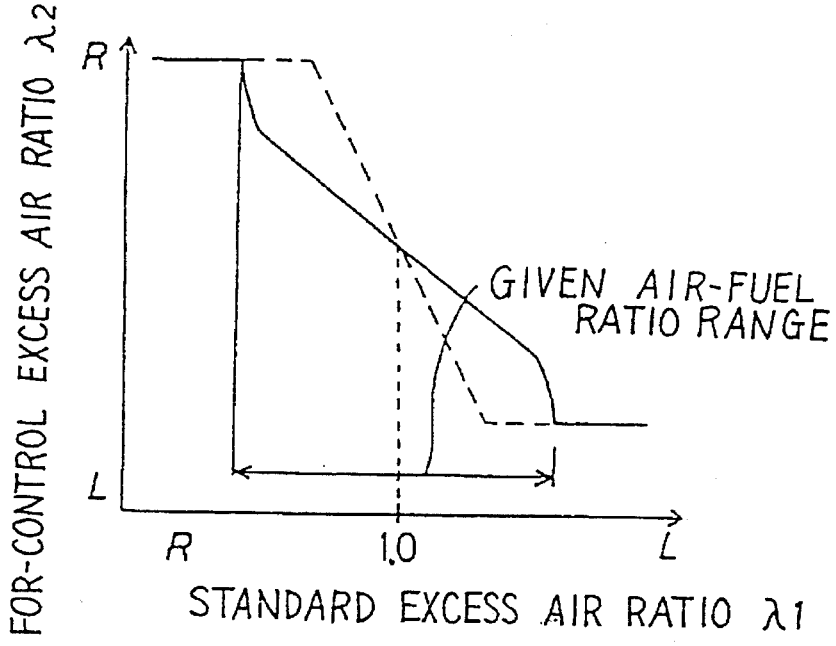
FIG. 7 is a characteristic map showing a relation between the standard excess air ratio and the for-control excess air ratio at an engine idling.

The derived standard excess air ratio $\lambda 1$ is fed to a correction linearizer 51 for the engine non-idling condition and a correction linearizer 53 for the engine idling condition. The correction linearizer 51 corresponds to the step 140 in FIG. 3, and the correction linearizer 53 corresponds to the step 190 in FIG. 3. The correction linearizer 51 has the characteristic map for the engine non-idling condition as shown in FIGS. 6A or 6B, and the correction linearizer 53 has the characteristic map for the engine idling condition as shown in FIG. 7. In practice, the data identified by these characteristic maps is also pre-stored in the ROM **31*b***.

The characteristic maps of FIGS. 6A or 6B and FIG. 7 respectively show relations between the standard excess air ratio $\lambda 1$ and the for-control excess air ratio $\lambda 2$. The characteristic maps also partly include a common basic relation between the standard excess air ratio $\lambda 1$ and the for-control excess air ratio $\lambda 2$. This common basic relation is shown in FIG. 8.

Figure 8:
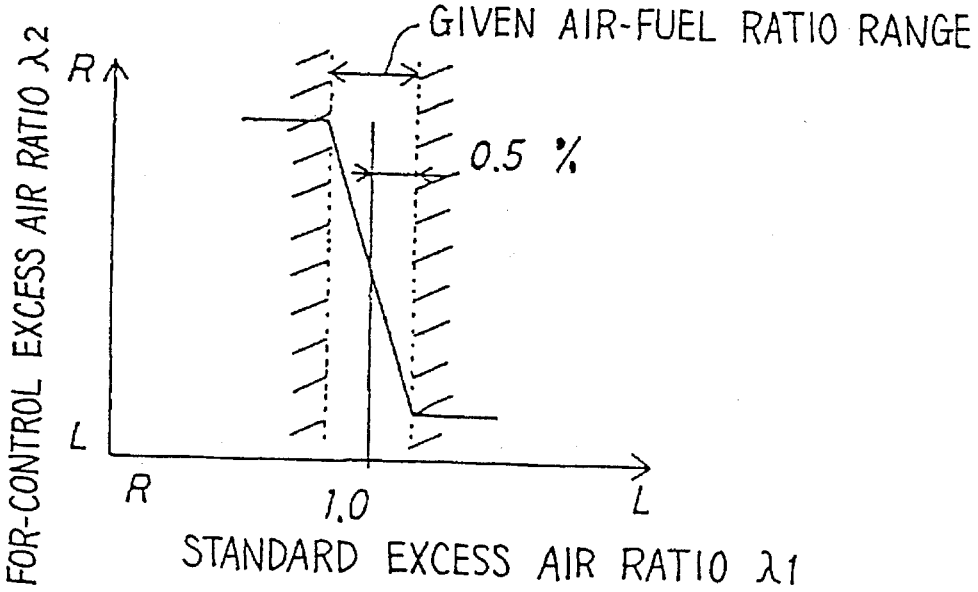
FIG. 8 is a characteristic map showing a common characteristic between the maps of FIGS. 6A, 6B and 7.

As seen in FIG. 8, the common basic relation for the for-control excess air ratio $\lambda 2$ is held constant outside a given air-fuel ratio range having a width of 1% across the standard excess air ratio $\lambda 1$ being 1.0, which represents the stoichiometric air-fuel ratio. Specifically, irrespective of variations in the standard excess air ratio $\lambda 1$, the for-control excess air ratio $\lambda 2$ does not vary outside the given air-fuel ratio range having the width of 1%, that is, 0.5% for each side across the standard excess air ratio $\lambda 1$ being 1.0. This given air-fuel ratio range corresponds to the foregoing given air-fuel ratio range shown in FIG. 12. Specifically, the unexpected unevenness or shift in level of the output voltage VOX, due to the individual characteristic of the employed oxygen sensor or due to the measuring temperatures, is very apparent outside the above-noted given air-fuel ratio range. On the other hand, within the above-noted given air-fuel range, such unevenness or shift in level of the output voltage VOX is small enough to be ignored, which has been confirmed by the inventors of the present invention through various experiments. For this reason, a common basic relation is relation is established in the characteristic maps for both the non-idling engine condition and for the idling engine condition so as to inhibit the unexpected unevenness or shift of the oxygen sensor output voltage VOX from reflecting upon the for-control excess air ratio $\lambda 2$ during the execution of the air-fuel ratio feedback control.

Now, the difference between the characteristic maps for the non-idling engine condition [FIGS. 6A or 6B] and the idling engine condition (FIG. 7) will be described. As shown in FIGS. 6A or 6B, in the characteristic map for the non-idling engine condition, the for-control excess air ratio $\lambda 2$ is shifted or biased in an upward or downward direction or in a rightward or leftward direction, that is, toward the RICH side or the LEAN side. Specifically, such a shift or bias is established only for the for-control excess air ratio $\lambda 2$, which corresponds to the standard excess air ratio $\lambda 1$ within the above-described given air-fuel ratio range in which the for-control excess air ratio $\lambda 2$ varies depending on variations of the standard excess air ratio $\lambda 1$. "RICH" or "LEAN" respectively means that the mixture gas is rich or lean with respect to the stoichiometric air-fuel ratio.

On the other hand, as shown in FIG. 7, in the characteristic map for the idling engine condition, a variation rate of the for-control excess air ratio $\lambda 2$ relative to a variation of the standard excess air ratio $\lambda 1$ is reduced in comparison with a basic variation rate of the for-control excess air ratio $\lambda 2$ represented by a dotted line. Such a reduced relation is established only for the for-control excess air ratio $\lambda 2$, which corresponds to the standard excess air ratio $\lambda 1$ within the above-described given air-fuel ratio range except for small width ranges respectively adjacent to the RICH and LEAN side ends of the above-noted given air-fuel ratio range.

Referring back to FIG. 4, the correction linearizer 51 and the correction linearizer 53 respectively output the for-control excess air ratio $\lambda 2$ corresponding to the standard excess air ratio $\lambda 1$ using the characteristic maps respectively for the engine non-idling condition and the engine idling condition. The for-control excess air ratio $\lambda 2$ output from the correction linearizer 51 is fed into a deviation calculation circuit 55, and the for-control excess air ratio $\lambda 2$ output from the correction linearizer 53 is fed into a deviation calculation circuit 57.

Each of the deviation calculation circuits 55 and 57 output a deviation $^{\Delta\lambda}$ between the for-control excess air ratio $^{\lambda}2$ and the target excess air ratio $^{\lambda}0$. Based on the calculated deviation $^{\Delta\lambda}$, the subsequent air-fuel ratio control is performed.

Before describing the subsequent air-fuel ratio control, reference is made to how the characteristic maps for the non-idling engine condition and the idling engine condition reflect upon the control characteristic of the air-fuel ratio.

As shown in FIG. 8 and as described above, both at the non-idling and idling engine condition, the for-control excess air ratio $^{\lambda}2$ is held constant outside the given air-fuel ratio range of the standard excess air ratio $^{\lambda}1$. However, when the for-control excess air ratio $^{\lambda}2$ is already held constant, the for-control excess air ratio $^{\lambda}2$ has already increased to a sufficiently large value or decreased to a sufficiently small value. On the other hand, when the standard excess air ratio $^{\lambda}1$ is within the given air-fuel ratio range, the for-control excess air ratio $^{\lambda}2$ varies depending on variations of the standard excess air ratio $^{\lambda}1$.

Accordingly, since the air-fuel ratio control is performed based on the deviation $^{\Delta\lambda}$ between the for-control excess air ratio $^{\lambda}2$ and the target excess air ratio $^{\lambda}0$, the high follow-up characteristic of the air-fuel ratio control is ensured over all the ranges of the standard excess air ratio $^{\lambda}1$. On the other hand, since the for-control excess air ratio $^{\lambda}2$ stops varying when the standard excess air ratio is outside the given air-fuel range, the unexpected unevenness or shift in level of the output of the oxygen sensor 19 is inhibited from reflecting onto the air-fuel ratio control. Accordingly, the highly reliable control performance is ensured to improve the exhaust emission.

Figure 9:
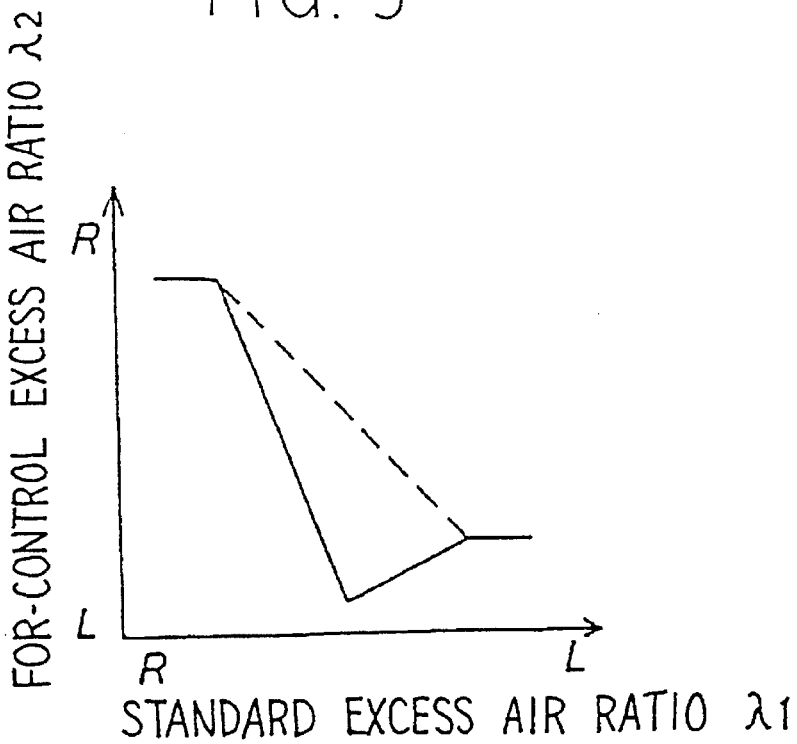
FIG. 9 is a characteristic map showing a particular characteristic selected from FIGS. 6A and 6B.

At the non-idling engine condition, the following control characteristic is attained when the standard excess air ratio $^{\lambda}1$ is within the given air-fuel ratio range:

FIG. 9 shows one example of FIGS. 6A or 6B, wherein the for-control excess air ratio $^{\lambda}2$ is biased toward the LEAN side as shown by a solid line. A dotted line shows the basic relation between the standard and for-control excess air ratios $^{\lambda}1$ and $^{\lambda}2$ with no such bias. When the biased relation identified by the solid line is available in the correction linearizer 51, the for-control excess air ratio $^{\lambda}2$ is output from the correction linearizer 51 as shown by a solid line in a timechart of FIG. 10. On the other hand, when the basic relation identified by the dotted line is available in the correction linearizer 51, the for-control excess air ratio $^{\lambda}2$ is output from the correction linearizer 51 as shown by a dotted line in the timechart of FIG. 10.

Figure 10:
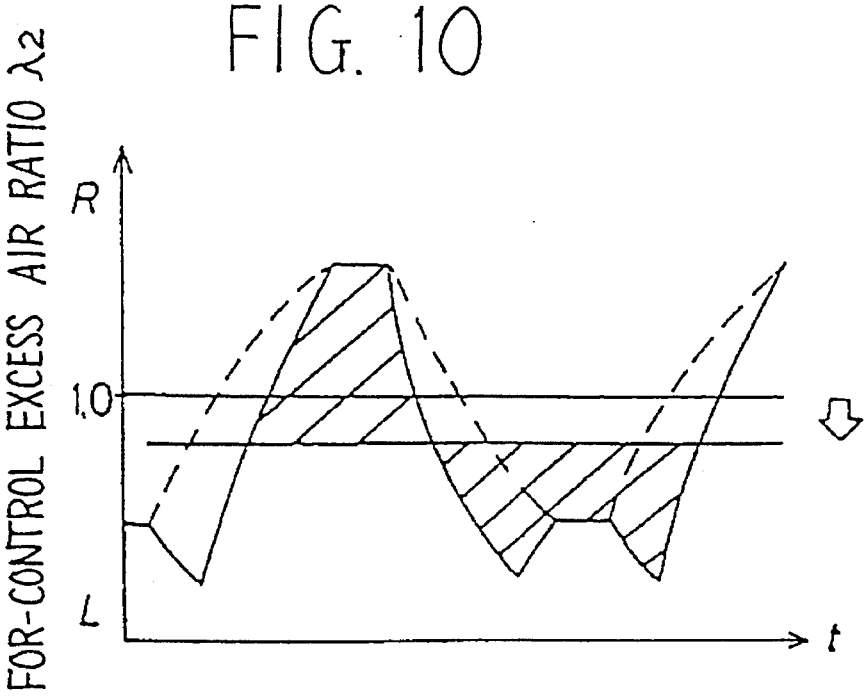
FIG. 10 is a timing chart showing variations of the for-control excess air ratio.
Figure 11:
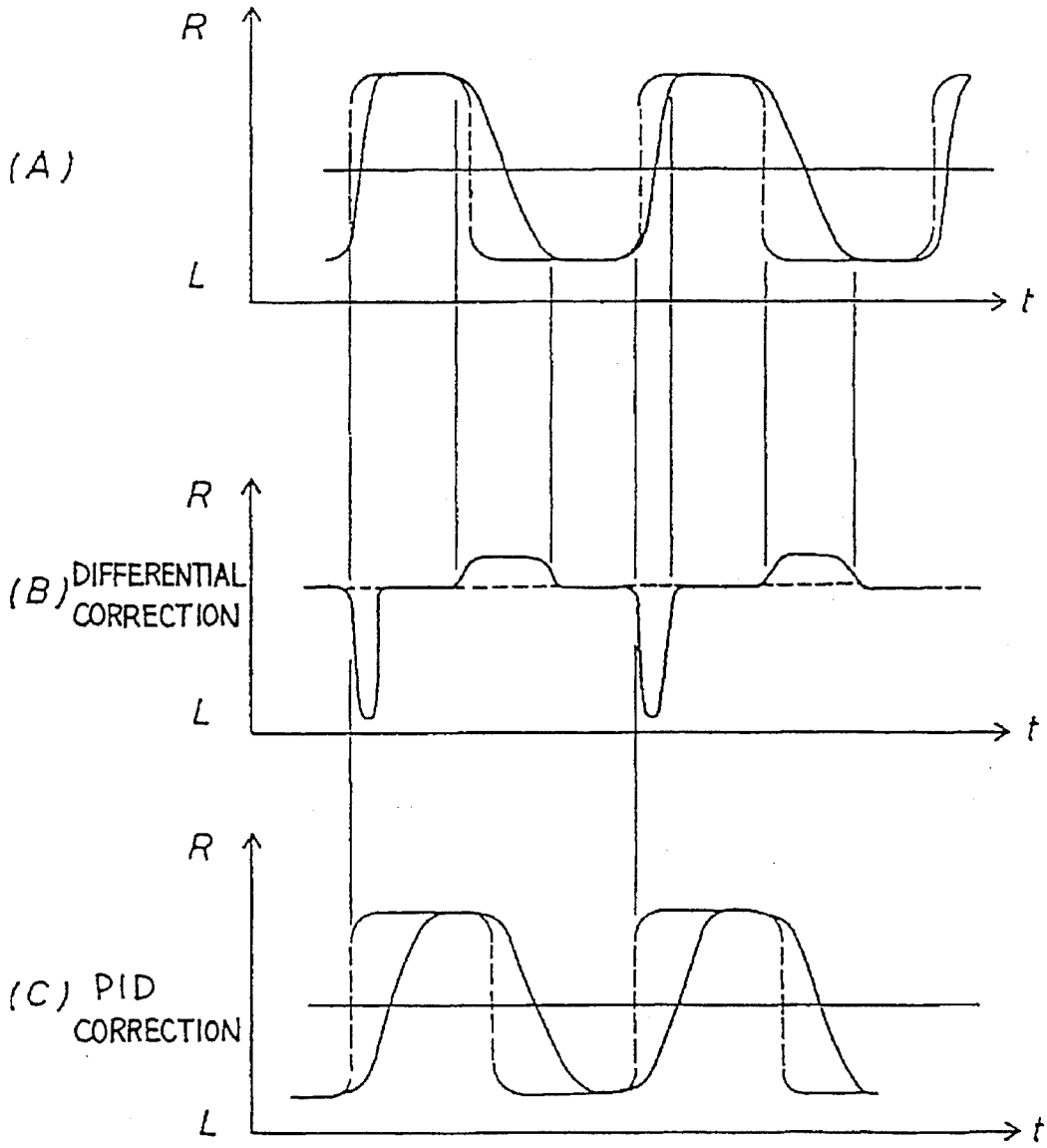
FIG. 11 contains timing charts showing a dynamic characteristic of the oxygen sensor, a differential correction and a PID correction.
Figure 12:
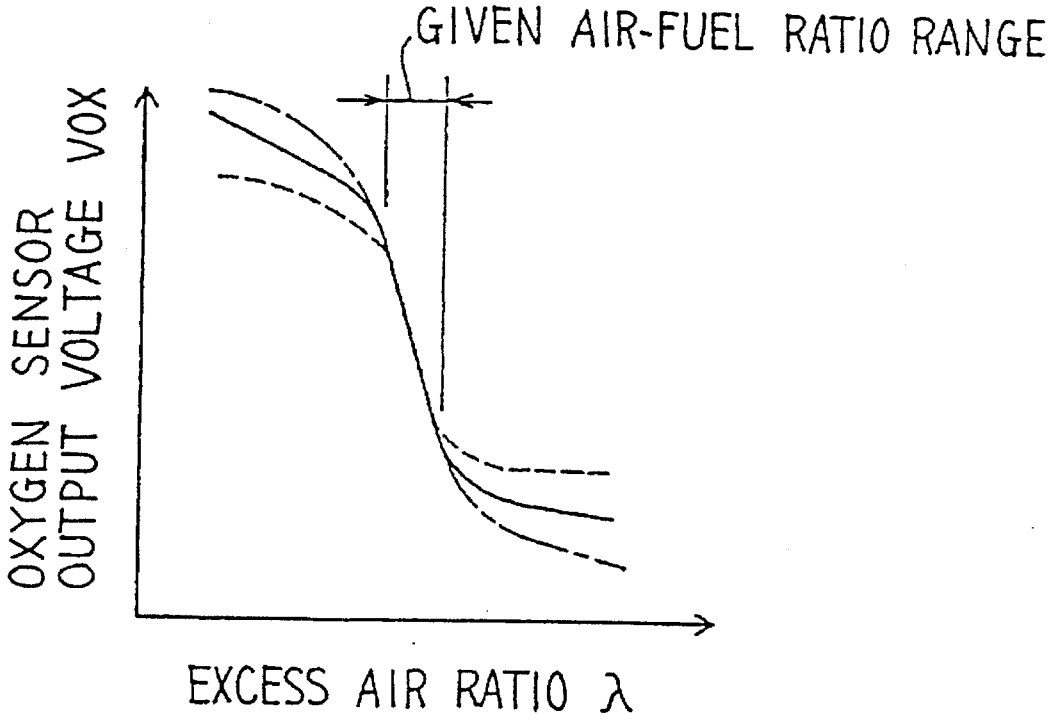
FIG. 12 is a characteristic map showing an output characteristic of the oxygen sensor.

In FIG. 10, when the for-control excess air ratio $^{\lambda}2$ is represented by the dotted line, a value 1.0 of the for control excess air ratio $^{\lambda}2$, which corresponds to the stoichiometric air-fuel ratio, makes an area of the RICH side equal to an area of the LEAN side. In other words, when the area of the RICH side is considered to be positive and the area of the LEAN side is considered to be negative, the mean value of both of them becomes zero. On the other hand, in the case of the solid line, the value 1.0 of the for-control excess air ratio $^{\lambda}2$, which corresponds to the stoichiometric air-fuel ratio $^{\lambda}2$, does not make the respective areas equal to each other, but instead makes an area of the LEAN side larger than an area of the RICH side.

This means that the center of the air-fuel ratio control is shifted toward the RICH side in order to compensate such a bias toward the LEAN side. Obviously, if the for-control excess air ratio $^{\lambda}2$ is biased toward the RICH side, as opposite to FIG. 9, then the center of the air-fuel ratio control is shifted toward the LEAN side to compensate the bias toward the RICH side. Accordingly, by changing or resetting an amount and a direction of such a bias or shift of the for-control excess air ratio $^{\lambda}2$, a delicate adjustment of the center of the air-fuel ratio control is accomplished. As a result, even if the optimum air-fuel ratio for the exhaust emission differs due to the individual characteristic of each engine, the center of the air-fuel ratio is easily adjusted to the required optimum air-fuel ratio by resetting the above-noted bias of the for-control excess air ratio $^{\lambda}2$.

At the idling engine condition, the following control characteristic is attained when the standard excess air ratio $^{\lambda}1$ is within the given air-fuel ratio range.

As shown in FIG. 7 and as described above, a variation rate of the for-control excess air ratio $^{\lambda}2$ identified by the solid line is set smaller than the reference variation rate identified by the dotted line. Such a reduced relation is established only for the for-control excess air ratio $^{\lambda}2$, which corresponds to the standard excess air ratio $^{\lambda}1$ within the above-described given air-fuel ratio range except for the small width ranges respectively adjacent to the RICH and LEAN side ends of the above-noted given air-fuel ratio range. Within such small width ranges, a variation rate of the for-control excess air ratio $^{\lambda}2$ is set larger than the reference variation rate and is immediately increased.

As a result, the variation rate of the for-control excess air ratio $^{\lambda}2$ can be set smaller than a variation rate of the actual excess air ratio to diminish the control amplitude so that a high idling stability is attained.

Further, when the standard excess air ratio $^{\lambda}1$ deviates far from the stoichiometric value to get close to the RICH and LEAN side end of the given air-fuel ratio range, the for-control excess air ratio $^{\lambda}2$ is immediately increased or decreased to provide the high follow-up characteristic.

Now, referring back to FIG. 4, the air-fuel ratio control based on the derived deviation $^{\Delta\lambda}$ will be described hereinbelow in detail.

The deviation $^{\Delta\lambda}$ output from the deviation calculation circuit 55 is fed to a PID controller 59 and PI controller 61, respectively. The PID controller 59 is for a steady engine condition and the PI controller 61 is for an immediate acceleration condition.

The PID controller 59 performs the feedback control identified by the following transfer function Gc(S):

$$Gc(S) = Kp \cdot \left( 1 + \frac{1}{Kis} \right) \cdot \frac{1 + Kd \cdot S}{1 + k \cdot Kd \cdot S} \tag{1}$$

where, Kp is a proportional constant, Ki is an integral constant, Kd is a differential constant and k is a differential weight constant.

In the equation (1), a differential factor (1+ Kd S)/(1+k Kd S) represents an approximate expression.

In practice, step 220 of the first air-fuel ratio feedback control routine in FIG. 3 calculates the feedback air-fuel ratio dependent correction coefficient FAF in accordance with the following equation (2), which is equivalent to the equation (1):

$$FAF = a \cdot FAFO - b \cdot FAFOO + c \cdot \Delta\lambda 0 + e \cdot \Delta\lambda 00 \tag{2}$$

where, FAF is the feedback air-fuel ratio dependent correction coefficient derived per a calculation cycle of 20 msec., FAFO is FAF derived in a last calculation cycle, FAFOO is FAF derived in a before-last calculation cycle, $^{\Delta\lambda}$ is a deviation derived per calculation cycle of 20 msec., $^{\Delta\lambda}0$ is the deviation $^{\Delta\lambda}$ derived in the last calculation cycle, and $^{\Delta\lambda}00$ is the deviation $^{\Delta\lambda}$ derived in the before-last calculation cycle.

The coefficients a, b, c, d and e of the respective terms in the equation (2) are derived based on the following equations (3) to (7):

$$a=\frac{1+\frac{2k\cdot Kd}{\Delta t}}{1+\frac{k\cdot Kd}{\Delta t}} \tag{3}$$

$$b=\frac{\frac{k\cdot Kd}{\Delta t}}{1+\frac{k\cdot Kd}{\Delta t}} \tag{4}$$

$$c=\frac{Kp\cdot\left(1+\frac{Kd}{Ki}+\frac{Kd}{\Delta t}+\frac{\Delta t}{Ki}\right)}{1+\frac{k\cdot Kd}{\Delta t}} \tag{5}$$

$$d=\frac{Kp\cdot\left(1+\frac{Kd}{Ki}+\frac{2Kd}{\Delta t}\right)}{1+\frac{k\cdot Kd}{\Delta t}} \tag{6}$$

$$e=\frac{Kp\cdot kd}{1+\frac{k\cdot Kd}{\Delta t}} \tag{7}$$

where, $^{\Delta}t$ is a calculation cycle.

Step 170 of the first air-fuel ratio feedback control routine in FIG. 3 derives the calculation parameters, i.e. the coefficients a, b, c, d and e based on the foregoing equations (3) to (7).

The PID control executed by the PID controller 59 will be explained with reference to FIGS. 11A–11C. FIG. 11A shows variations in the output of the oxygen sensor 19. As described before, in general, a response time of the oxygen sensor 19 is longer when changing from RICH to LEAN than from LEAN to RICH as identified by a solid line. FIG. 11B shows a signal derived by differentiating the oxygen sensor output of FIG. 11A. FIG. 11C shows a signal after executing the PID control of the oxygen sensor output of FIG. 11A based on the foregoing equation (1). Accordingly, the PID controller 59 outputs the signal identified by a solid line in FIG. 11C.

As seen from the signal of FIG. 11C, the above-mentioned difference in the response time of the oxygen sensor 19, due to its dynamic characteristic, is substantially eliminated by the differential action, i.e. the response times from LEAN to RICH and from RICH to LEAN are substantially equal to each other. Accordingly, the PID control performed by the PID controller 59 effectively eliminates the conventional problem that the center of the air-fuel ratio control is deviated toward the LEAN side due to the dynamic characteristic of the oxygen sensor 19. As a result, the center of the air-fuel ratio control is stably controlled at the target value so that the exhaust emission is controlled properly.

As described above, the differential factor represents the approximate expression, which suppresses the influence of ripples contained in the oxygen sensor output voltage.

On the other hand, the PI controller 61 performs the feedback control identified by the following transfer function Gc(S):

$$Gc(S)=Kp\cdot\left(1+\frac{1}{KiS}\right) \tag{8}$$

where, Kp is a proportional constant and Ki is an integral constant.

The equation (8) does not include the differential factor (1+Kd S)/(1+k Kd S), which is included in the equation (1). In practice, step 220 in FIG. 3 derives the feedback air-fuel ratio dependent correction coefficient FAF for the immediate acceleration condition based on the following equation (9), which is equivalent to the equation (8):

$$FAF=a\ FAFO-b\ FAFOO+c\ ^{\Delta\lambda}0+e\ ^{\Delta\lambda}00 \tag{9}$$

where, FAF is the feedback air-fuel ratio dependent correction coefficient derived per calculation cycle of 20 msec., FAFO is FAF derived in a last calculation cycle, FAFOO is FAF derived in a before-last calculation cycle, $^{\Delta\lambda}$ is a deviation derived per calculation cycle of 20 msec., $^{\Delta\lambda}0$ is the deviation $^{\Delta\lambda}$ derived in the last calculation cycle, and $^{\Delta\lambda}00$ is the deviation $^{\Delta\lambda}$ derived in the before-last calculation cycle.

The coefficients a, b, c, d and e of the respective terms in the equation (9) are derived based on the following equations (10) to (14):

$$a=1 \tag{10}$$

$$b=0 \tag{11}$$

$$d=Kp \tag{12}$$

$$e=0 \tag{13}$$

where, $^{\Delta}t$ is a calculation cycle.

Step 180 in FIG. 3 derives the calculation $$c=\frac{Kp\cdot\left(1+\frac{Ki}{\Delta t}\cdot\Delta t\right)}{Ki} \tag{14}$$

parameters, i.e. the coefficients a, b, c, d and e based on the equations (10) to (14).

The PI control is performed under the immediate acceleration due to the following reason.

In the foregoing PID control, the oxygen sensor output signal is corrected by the differential action in order to substantially eliminate the influence of the dynamic characteristic of the oxygen sensor 19. However, the differential action also works to deteriorate the follow-up characteristic of the control. Since the transitional condition, such as the immediate acceleration condition, requires a high follow-up controllability of the air-fuel ratio, the air-fuel ratio control, under such a condition, is performed based on the PI control that includes no differential factor. As a result, the center of the air-fuel ratio control quickly follows the target air-fuel ratio.

The feedback air-fuel ratio dependent correction coefficients FAF are output from the PID controller 59 and the PI controller 61 and are fed to a first selection circuit 63. The first selection circuit 63 is also fed a pressure variation $^{\Delta}Pm$ from the intake vacuum sensor 13 and corresponds to the step 160 in FIG. 3. The first selection circuit 63 determines, based on the input pressure variation $^{\Delta}Pm$, whether the engine is under the steady condition or the immediate acceleration. When a steady condition is determined, the first selection circuit 63 outputs the correction coefficient FAF fed from the PID controller 59 to a second selection circuit 67. On the other hand, when an immediate acceleration is determined, the first selection circuit 63 outputs the correction coefficient FAF fed from the PI controller 61 to the second selection circuit 67.

Now, the calculation of the feed back air-fuel ratio dependent correction coefficient FAF for the idling engine condition will be explained.

The deviation $^{\Delta\lambda}$, output from the deviation calculation circuit 57, is fed to a PI controller 65. The PI controller 65 performs the feedback control identified by the following transfer function Gc(S):

$$Gc(S) = Kp \cdot \left( 1 + \frac{1}{KiS} \right) \tag{15}$$

where, Kp is a proportional constant and Ki is an integral constant.

The foregoing transfer function Gc(S) for the immediate acceleration condition, equation (15), does not include the differential factor (1+Kd S)/(1+k Kd S) which is included in the equation (1) for the non-idling engine steady condition. In practice, step 220 in FIG. 3 calculates the feedback air-fuel ratio dependent correction coefficient FAF based on the following equation (16), which is equivalent to equation (15).

$$FAF = a\ FAFO - b\ FAFOO + c\ ^{\Delta\lambda}0 - d\ ^{\Delta\lambda} + e\ ^{\Delta\lambda}0 \tag{16}$$

where, FAF is the feedback air-fuel ratio dependent correction coefficient derived per a calculation cycle of 20 msec., FAFO is FAF derived in a last calculation cycle, FAFOO is FAF derived in a before-last calculation cycle, $^{\Delta\lambda}$ is a deviation derived per a calculation cycle of 20 msec., $^{\Delta\lambda}0$ is the deviation $^{\Delta\lambda}$ derived in the last calculation cycle, and $^{\Delta\lambda}00$ is the deviation $^{\Delta\lambda}$ derived in the before-last calculation cycle.

The coefficients a, b, c, d and e of the respective terms in equation (16) are derived based on the following equations (17) to (21):

$$a = 1 \tag{17},$$

$$b = 0 \tag{18},$$

$$d = Kp \tag{19}$$

$$e = 0 \tag{20}$$

$$c = \frac{Kp \cdot \left( 1 + \frac{Ki}{\Delta t} \right) \cdot \Delta t}{Ki} \tag{21}$$

where, $^{\Delta}t$ is a calculation cycle.

The proportional constant Kp in equation (19) and the integral constant Ki in equation (21) are respectively set to values that are different from the proportional constant Kp in equation (12) and the integral constant Ki in equation (14) for the immediate acceleration condition.

Step 210 in FIG. 3 derives the calculation parameters, i.e. the coefficients a, b, c, d and e based on the equations (17) to (21).

The feedback air-fuel ratio dependent correction coefficient FAF output from the PI controller 65 is fed to the second selection circuit 67. The second selection circuit 67 is also fed a signal from the idle switch **15*b* indicative of engine idling data and corresponds to the step 130 in FIG. 3**.

The second selection circuit 67 determines, based on the input idling data indicative signal, whether the engine is idling or not. When the non-idling engine condition is determined, the second selection circuit 67 outputs the correction coefficient FAF fed from the PID controller 59 or the PI controller 61 to the engine 1. On the other hand, when the idling engine condition is determined, the second selection circuit 67 outputs the correction coefficient FAF fed from the PI controller 65 to the engine 1. The engine 1 performs the air-fuel ratio feedback control based on the input correction coefficient FAF in a known manner.

As appreciated from the foregoing description, the first preferred embodiment has the following advantages.

As shown in FIG. 8, when the standard excess air ratio $^{\lambda}1$ derived based on the output signal from the oxygen sensor 19 is within the given air-fuel ratio range, the for-control excess air ratio $^{\lambda}2$ varies according to variations in the standard excess air ratio $^{\lambda}1$. On the other hand, when the standard excess air ratio $^{\lambda}1$ is outside the given air-fuel ratio range, the for-control excess air ratio $^{\lambda}2$ is held constant. Accordingly, not only a high follow-up characteristic of the control is realized, but the unexpected unevenness or shift in level of the oxygen sensor output is effectively excluded from the air-fuel ratio feedback control. As a result, a highly reliable control performance is ensured to improve exhaust emissions.

Further, since the PID control is executed during the engine non-idling steady condition, the dynamic characteristic of the oxygen sensor 19, as shown in FIG. 11A, is effectively compensated to substantially equalize the response times from LEAN to RICH and from RICH to LEAN as shown in FIG. 11C. Accordingly, the deviation or bias of the center of the air-fuel ratio control toward the LEAN side is prevented as opposed to the prior art so that the exhaust emission is improved.

Further, as shown in FIG. 7, the variation of the for-control excess air ratio $^{\lambda}2$ for the idling engine condition is set smaller within the given air-fuel ratio range of the standard excess air ratio $^{\lambda}1$ except for at the LEAN and RICH side ends thereof. Since the air-fuel ratio feedback control is performed based on the deviation $^{\Delta\lambda}$, between the for-control excess air ratio $^{\lambda}2$ and the target excess air ratio $^{\lambda}0$, the improved follow-up controllability of the air-fuel ratio, as well as the high engine stability, are ensured during engine idling.

Further, since the for-control excess air ratio $^{\lambda}2$ is set biased or shifted toward the RICH or LEAN side in comparison with the actual excess air ratio, as shown in FIGS. 6A or 6B, the center of the air-fuel ratio control is shifted toward the LEAN or RICH side respectively to compensate for such a bias of the for-control excess air ratio $^{\lambda}2$. Accordingly, by adjusting a magnitude and a direction of the bias, the center of the air-fuel ratio control is delicately adjusted to the optimum air-fuel ratio depending on the individual characteristic of the engine so as to improve exhaust emissions.

Further, the PID control is executed during the engine non-idling steady condition to put more weight on the stability of the air-fuel ratio control. On the other hand, the PI control, which includes no differential action, is executed during the immediate acceleration to put more weight on the follow-up characteristic of the control. Accordingly, the desirable control characteristic is provided depending on the vehicular running condition.

The linear characteristics of the correction linearizers 51 and 53, defined by the respective linear functions, may be replaced by proper curved characteristics defined by a quadratic function. Further, the characteristics of the correction linearizers 51 and 53 may be given in the form of conversion table data or matrix data. Obviously, the detection of the engine idling condition and the immediate acceleration condition etc. may also be performed by known means other than those disclosed in the first preferred embodiment.

Now, a second preferred embodiment of the air-fuel ratio control system according to the present invention will be described with reference to FIGS. 13 to 21. In these figures, the same or like members or components are designated by the same reference numerals as in the first preferred embodiment to omit explanation thereof so as to avoid a redundant disclosure.

In the second preferred embodiment, the foregoing biased characteristic of the correction linearizer 51, identified by the dotted line in FIGS. 6A and 6B and by the solid line in FIG. 9, is further corrected by an output from a downstream oxygen sensor 119. Specifically, the characteristic of the correction linearizer 51 that the for-control excess air ratio $^{\lambda}2$ is biased or shifted toward the RICH or LEAN side is further corrected based on the output of the downstream oxygen sensor 119 toward the RICH and LEAN side.

Figure 13:
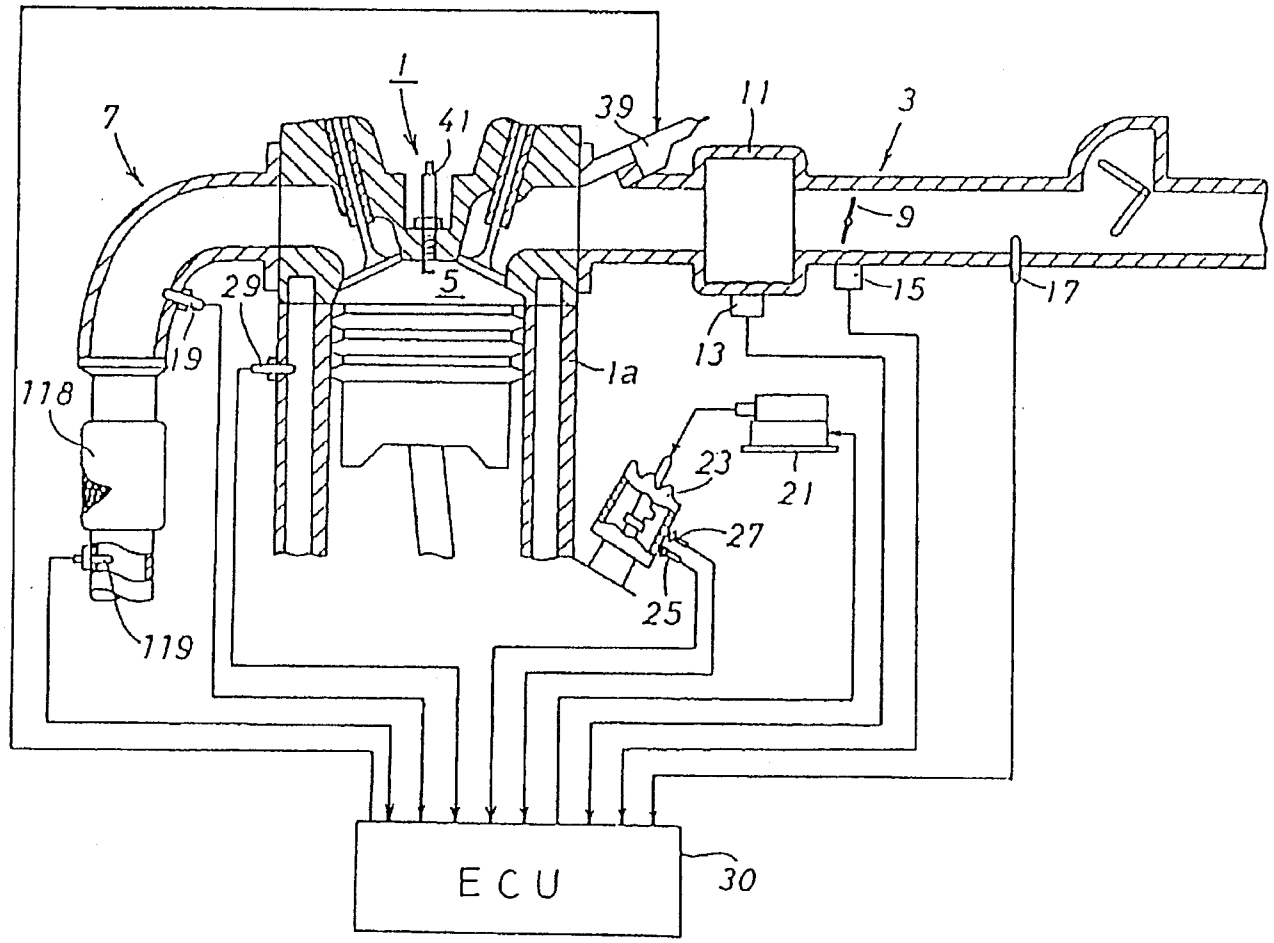
FIG. 13 is a sectional view showing a structure of an internal combustion engine, wherein upstream and downstream oxygen sensors are provided.

As schematically shown in FIG. 13, the downstream oxygen sensor 119 is provided in the exhaust system 7 downstream of a catalytic converter 118, which is provided downstream of the oxygen sensor 19 (hereinafter referred to as "the upstream oxygen sensor 19" or "the oxygen sensor 19"). The output of the downstream oxygen sensor 119 is also fed into the ECU 30.

Figure 14:
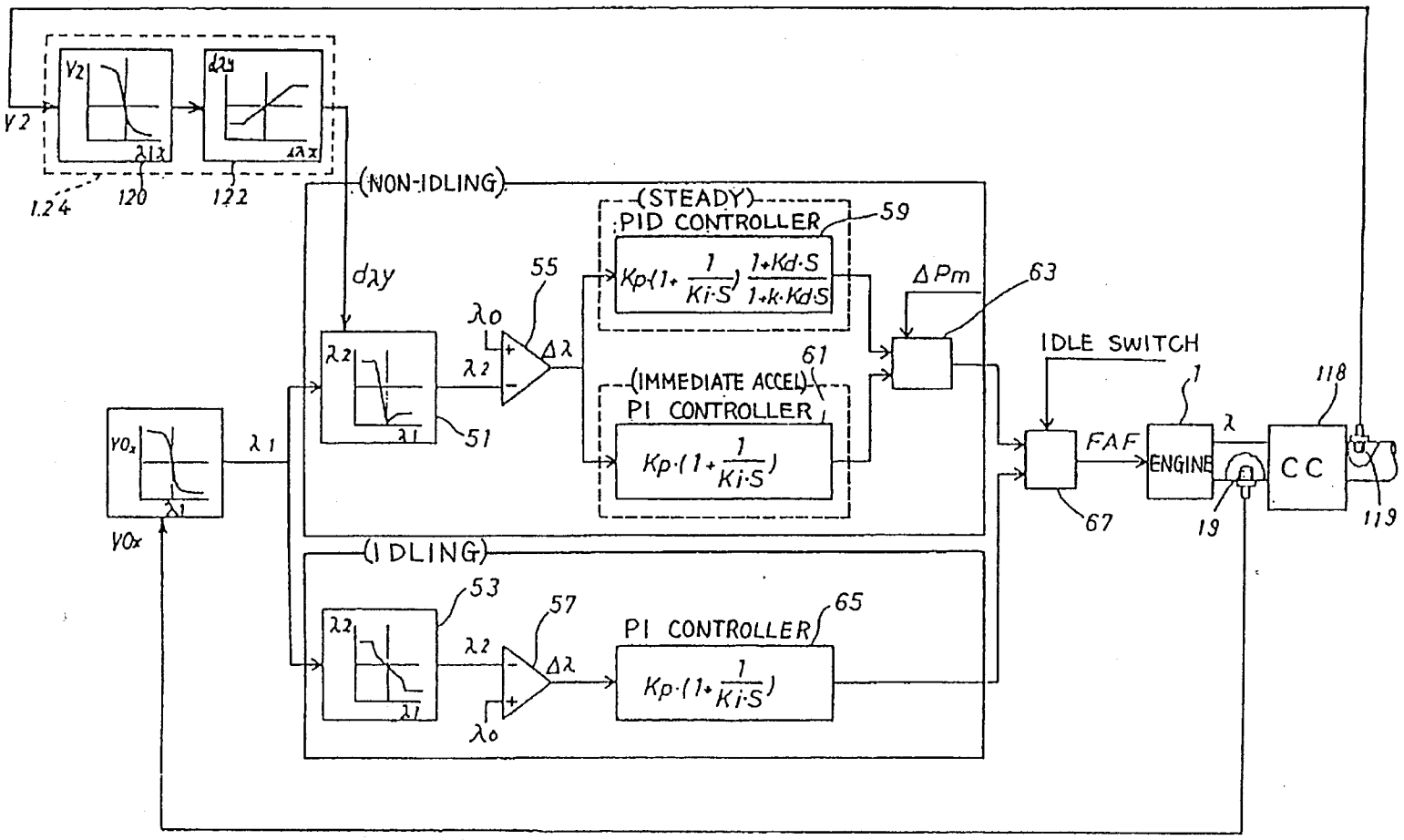
FIG. 14 is a block diagram for explaining an operation of a second preferred embodiment of the present invention.
Figure 16:
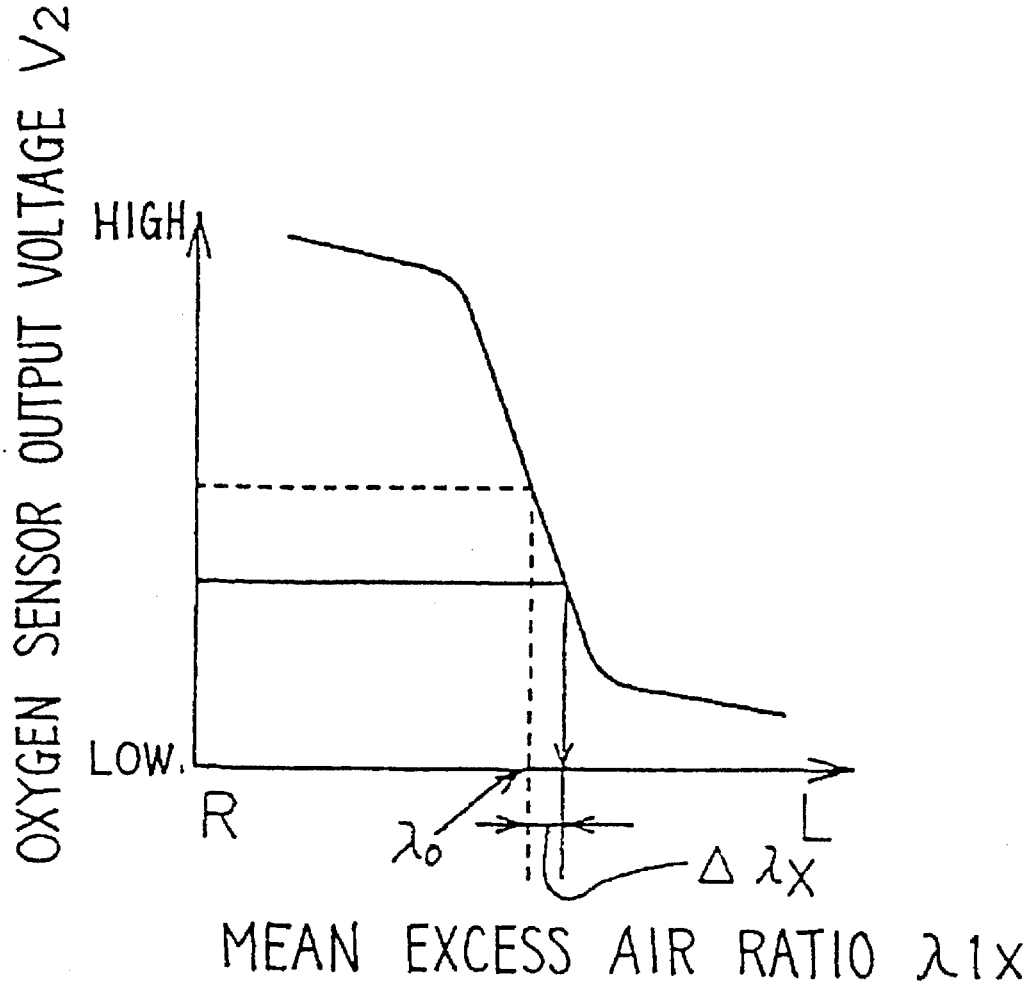
FIG. 16 is a characteristic map showing a relation between an output voltage of the downstream oxygen sensor and a mean excess air ratio.

As shown in a block diagram of FIG. 14, a mean excess air ratio $^{\lambda}{}_{1X}$ is derived based on an output voltage V2 of the downstream oxygen sensor 119 using the map in FIG. 16 or in block 120, which defines a relation between the output voltage V2 and the mean excess air ratio $^{\lambda}{}_{1X}$, which represents an estimated excess air ratio contained in the actual mixture gas in view of the output voltage V2. Then, a correction amount $d^{\lambda}{}_{X}$ is derived using the map in FIG. 17 or block 122, which defines a relation between a deviation $^{\Delta\lambda}{}_{X}$ derived by subtracting the mean excess air ratio $^{\lambda}{}_{1X}$ from a target excess air ratio $^{\lambda}0$ and the correction amount $d^{\lambda}{}_{Y}$. Based on the derived correction amount $d^{\lambda}{}_{Y}$, the foregoing biased for-control excess air ratio $^{\lambda}2$, in the correction linearizer 51, is further corrected toward the RICH or LEAN side within the foregoing given air-fuel ratio range of the standard excess air ratio $^{\lambda}1$. Subsequently, based on the further corrected for-control excess air ratio $^{\lambda}2$, the air-fuel ratio control is performed in substantially the same manner as in the first preferred embodiment.

The output of the downstream oxygen sensor 119 is more reliable than that of the upstream oxygen sensor 19 in view of the following reasons.

Downstream of the catalytic converter where the downstream oxygen sensor 119 is provided:

(1) An oxygen concentration in the exhaust gas is substantially equalized. Accordingly, a variation in the output characteristic of the oxygen sensor, due to its individual characteristic, is suppressed and small.

(2) Since an exhaust gas temperature is relatively low, a heat based influence to the oxygen sensor is small. Further, since harmful substances in the exhaust gas are caught in the catalytic converter, the oxygen sensor is subject to less harmful substances. Accordingly, time dependent variations in the output characteristic of the oxygen sensor is suppressed and small.

In the foregoing first preferred embodiment, there is a possibility that the output of the oxygen sensor 19 becomes unreliable due to uneven air-fuel ratios distributed in the exhaust gas discharged from a plurality of the engine cylinders or due to a time dependent deterioration of the oxygen sensor 19. As a result, the center of the air-fuel ratio control is deviated from the target air-fuel ratio. The result is a deteriorated exhaust emission.

Accordingly, in the second preferred embodiment, the foregoing biased for-control excess air ratio $^{\lambda}2$ is further corrected toward the RICH or LEAN side within the given air-fuel ratio range of the standard excess air ratio $^{\lambda}1$, depending on the more reliable output voltage V2 of the downstream oxygen sensor 119. This leads to the more reliable air-fuel ratio control enabling the center of the air-fuel ratio control to be delicately adjusted to the target air-fuel ratio improving the exhaust emissions.

In the second preferred embodiment, the output voltage V2 of the downstream oxygen sensor 119 is used to derive the mean excess air ratio $^{\lambda}{}_{1X}$, which is pre-stored as map data accessible in terms of the output voltage V2, but not used for determining RICH or LEAN in an on-off manner. Since the foregoing biased for-control excess air ratio $^{\lambda}2$ is further corrected within the above-noted given air-fuel range toward the RICH or LEAN side based on the deviation $^{\Delta\lambda}{}_{X}$ between the mean excess air ratio $^{\lambda}{}_{1X}$ and the target excess air ratio $^{\lambda}0$, the center of the air-fuel ratio control is more delicately adjusted to the target air-fuel ratio depending on a degree of RICH or LEAN of the actual air-fuel ratio detected by the downstream oxygen sensor 119.

Figure 15:
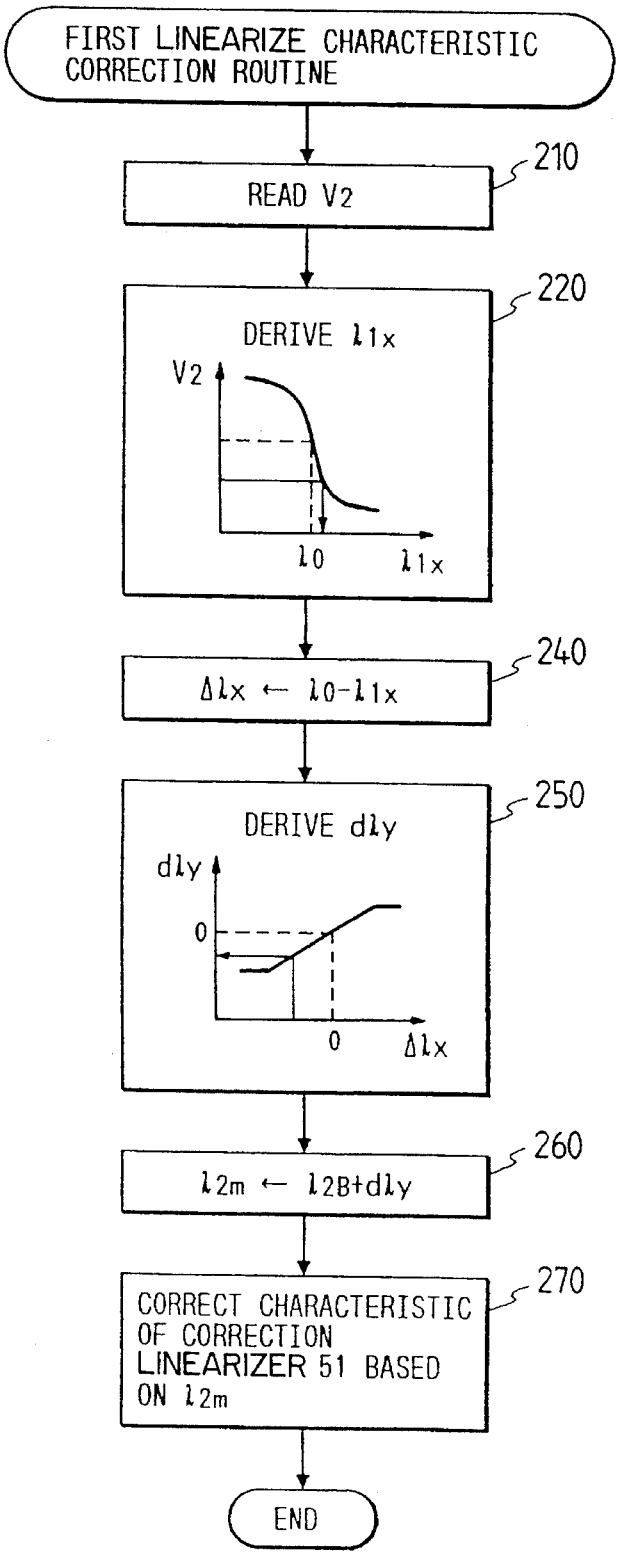
FIG. 15 is a flowchart showing a first linearized characteristic correction routine according to the second preferred embodiment.

FIG. 15 shows a first linearized characteristic correction routine executed by the CPU 31*a* in the ECU 30 as a timer interrupt per cycle, which is longer than that of the first air-fuel ratio feedback control routine in FIG. 3. In the second preferred embodiment, the microcomputer 31 in FIG. 2 is also fed the output signal from the downstream oxygen sensor 119 via the A/D converter 41.

In FIG. 15, at first step 210, the output voltage V2 of the downstream oxygen sensor 119 is read out via the A/D converter 41. The downstream oxygen sensor 119 is of the same type as the oxygen sensor 19, i.e. of the electromotive-force-type, and monitors the oxygen concentration in the exhaust gas.

Figure 17:
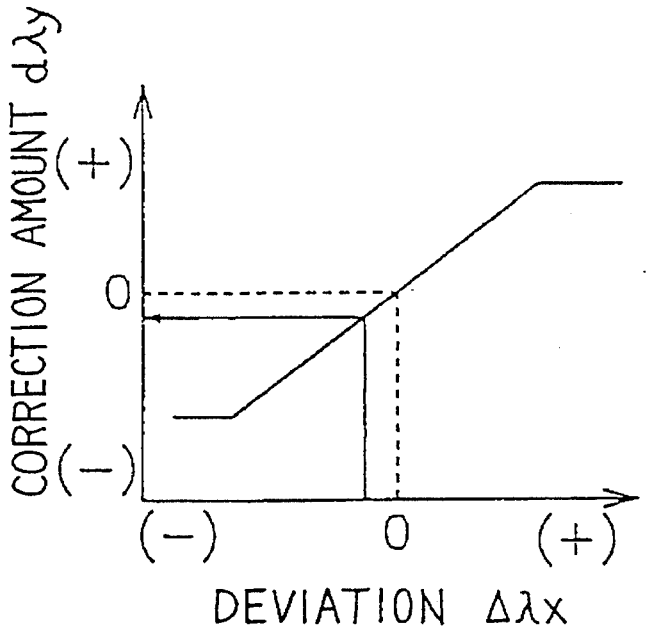
FIG. 17 is a characteristic map showing a relation between a deviation and a correction amount.

Steps 220 to 270 correspond to block 124 in FIG. 14, wherein the correction amount $d^{\lambda}{}_{Y}$ is derived based on the read-out output voltage V2 using the maps of FIGS. 16 and 17 or of the blocks 120 and 122 and the biased characteristic of the correction linearizer 51 is further corrected based on the derived correction amount $d^{\lambda}{}_{Y}$.

Specifically, at step 220, the mean excess air ratio $^{\lambda}{}_{1X}$ is derived based on the read-out output voltage V2 using the map in block 120. Subsequently, at the step 240, the deviation $^{\Delta\lambda}{}_{X}$ is derived by subtracting the mean excess air ratio $^{\lambda}{}_{1X}$ from the target excess air ratio $^{\lambda}0$ and it is stored in the RAM 31*c*. Since the downstream oxygen sensor 119 is of the same type as the oxygen sensor 19, the map in block 120 represents substantially the same characteristic as that of the foregoing linearizer 50 in the first preferred embodiment. Accordingly, when the actual air-fuel ratio becomes larger (LEAN) than the target air-fuel ratio in order to increase the oxygen concentration in the exhaust gas, the output voltage V2 decreases so that the deviation $^{\Delta\lambda}{}_{X}$ becomes negative. On the other hand, when the actual air-fuel ratio becomes smaller (RICH) than the target air-fuel ratio, the output voltage V2 increases so that the deviation $^{\Delta\lambda}{}_{X}$ becomes positive.

At the subsequent step 250, the correction amount $d^{\lambda}{}_{Y}$ is derived based on the derived deviation $^{\Delta\lambda}{}_{X}$ using the map in the block 122. As shown in FIG. 17, in the map of the block 122, the correction amount $d^{\lambda}_{Y}$ is directly proportional to the deviation $^{\Delta\lambda}_{X}$ within a given range across a zero value of the deviation $^{\Delta\lambda}_{X}$. Specifically, the given range of the deviation $^{\Delta\lambda}_{X}$ comprises the same given width on the positive and negative sides with respect to the zero value of the deviation $^{\Delta\lambda}_{X}$. On the other hand, the correction amount $d^{\lambda}_{Y}$ is held constant outside the given range of the deviation $^{\Delta\lambda}_{X}$ irrespective of variations in the deviation $^{\Delta\lambda}_{X}$.

Subsequently, the steps 260 and 270 correct the biased characteristic of the correction linearizer 51 as identified by the solid line in FIG. 9 based on the correction amount $d^{\lambda}_{Y}$ derived at step 250.

Figure 18:
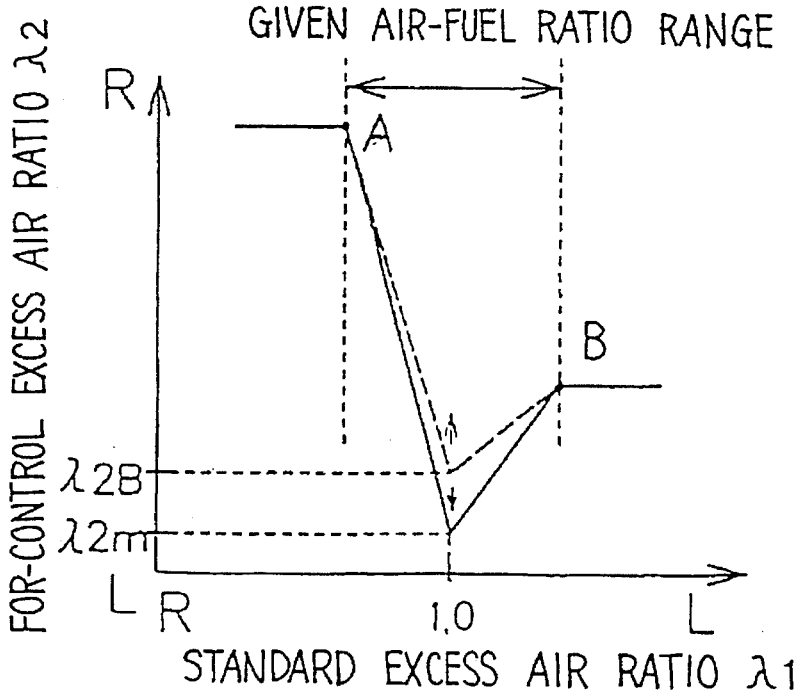
FIG. 18 is a graph for explaining a correction of the characteristic of a correction linearizer.
Figure 19:
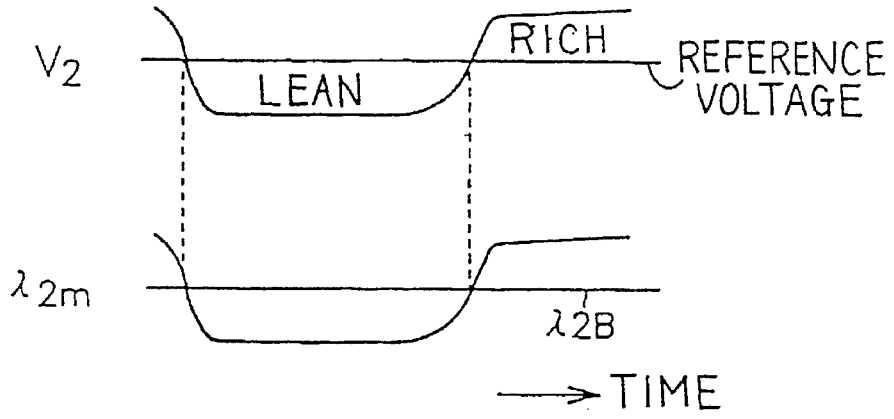
FIG. 19 is a timing chart showing an effect of the correction shown in FIG. 18 relative to time-domain variations in the output of the downstream oxygen sensor.

In FIG. 18, a dotted line corresponds to the solid line in FIG. 9, that is, the characteristic of the correction linearizer 51 before this correction routine. On the other hand, a solid line represents the characteristic of the correction linearizer 51 corrected by this correction routine. An intersection between a dotted line extending from a RICH side end point A of the given air-fuel ratio range and a dotted line extending from a LEAN side end point B thereof is defined as an X-Y coordinate position $(^{\lambda}1, ^{\lambda}2)=(1.0, ^{\lambda}_{2B})$. The Y-coordinate $^{\lambda}_{2B}$ will be hereinafter referred to as "the before-correction base value".

At step 260, the correction amount $d^{\lambda}_{Y}$ is added to the before-correction base value $^{\lambda}_{2B}$ to derive a corrected Y-coordinate $^{\lambda}_{2M}$, which is stored in the RAM 31*c*. The Y-coordinate $^{\lambda}_{2M}$ will be hereinafter referred to as "the corrected base value".

At the step 270, the X-Y coordinate position $(1.0, ^{\lambda}_{2B})$ is shifted to a corrected X-Y coordinate position $(1.0, ^{\lambda}_{2M})$ as indicated by an arrow in FIG. 18. Further, at step 270, the corrected X-Y coordinate position $(1.0, ^{\lambda}_{2M})$ is connected to the point A and point B respectively so as to attain the corrected linearized characteristic of the correction linearizer 51. In the corrected linearized characteristic, the linearized characteristic identified by the dotted line in FIG. 18 is biased further toward the LEAN side by the correction amount $d^{\lambda}_{Y}$. Obviously, magnitude and direction of the correction of the X-Y coordinate position $(1.0, ^{\lambda}_{2B})$, i.e. the linearizer characteristic identified by the dotted line in FIG. 18, depend on the correction amount $d^{\lambda}_{Y}$ derived at the step 250.

The corrected characteristic of the correction linearizer 51 is stored in a RAM energized by a special power source, which is constantly charged by the vehicular battery, and this correction routine is ended. Subsequently, based on the linearized characteristic corrected by this correction routine, the air-fuel feedback control is performed as in the first preferred embodiment and as shown in FIG. 14.

Further explanation will be made hereinbelow to the correction routine in FIG. 15.

As shown by an arrow in FIG. 16, when the oxygen concentration in the exhaust gas downstream of the catalytic converter 118 becomes higher (LEAN) than the target excess air ratio $^{\lambda}0$, the output voltage V2 of the downstream oxygen sensor 119 decreases thereby increasing the means excess air ratio $^{\lambda}_{1X}$ so that the deviation $^{\Delta\lambda}_{X}$ becomes a negative value. As shown by an arrow in FIG. 17, since the deviation $^{\Delta\lambda}_{X}$ is a negative value, the correction amount $d^{\lambda}_{Y}$ also becomes a negative value so that, as shown by the solid line in FIG. 18, the biased characteristic of the correction linearizer 51 is further corrected toward the LEAN side. Accordingly, the for-control excess air ratio $^{\lambda}2$ is adjusted toward the LEAN side so that the deviation $^{\Delta\lambda}$ between the for-control excess air ratio $^{\lambda}2$ and the target excess air ratio $^{\lambda}0$ becomes a larger negative value in comparison with that derived before the first correction routine of FIG. 15. The air-fuel ratio feedback control is performed based on the feedback air-fuel ratio dependent correction coefficient FAF, which is derived using this deviation $^{\Delta\lambda}$ having the larger, negative value. As a result, the center of the air-fuel ratio control, which is deviated to the LEAN side, is delicately adjusted toward the RICH side in order to bring the actual excess air ratio to the target excess air ratio $^{\lambda}0$. This is shown in FIG. 10.

In the first linearized characteristic correction routine as described above, the correction amount $d^{\lambda}_{Y}$ is directly proportional to the deviation $^{\Delta\lambda}_{X}$ within the predetermined range of the deviation $^{\Delta\lambda}_{X}$. Since the deviation $^{\Delta\lambda}_{X}$ is derived by subtracting the mean excess air ratio $^{\lambda}_{1X}$ derived based on the output voltage V2 of the downstream oxygen sensor 119 from the target excess air ratio $^{\lambda}0$, the corrected base value $^{\lambda}_{2M}$, derived by adding the correction amount $d^{\lambda}_{Y}$ to the before-correction base value $^{\lambda}_{2B}$, represents a degree of bias or shift of the corrected characteristic of the correction linearizer 51 toward the RICH or LEAN side. As shown in a timechart of FIG. 19, time-domain variations of the corrected base value $^{\lambda}_{2M}$ corresponds to time-domain variations of the output voltage V2 of the downstream oxygen sensor 119.

As appreciated from the foregoing description, according to the second preferred embodiment, the for-control excess air ratio $^{\lambda}2$, derived by the biased characteristic of the correction linearizer 51, is further corrected toward the RICH or LEAN side within the given air-fuel ratio of the standard excess air ratio $^{\lambda}1$ according to the reliable output voltage V2 of the downstream oxygen sensor 119. Accordingly, the center of the air-fuel ratio feedback control is delicately adjusted to the target air-fuel ratio to improve the exhaust emission.

In the second preferred embodiment, the biased characteristic of the correction linearizer 51 identified by the solid line in FIG. 9 is further corrected by the first linearized characteristic correction routine in FIG. 15. Instead of this, the non-biased characteristic of the correction linearizer 51 identified by the dotted line in FIG. 9 may be corrected by the first correction routine of FIG. 15. In this case, the before-correction base value $^{\lambda}_{2B}$ may be a Y-coordinate corresponding to a predetermined X-coordinate such as the X-coordinate 1.0.

Figure 20:
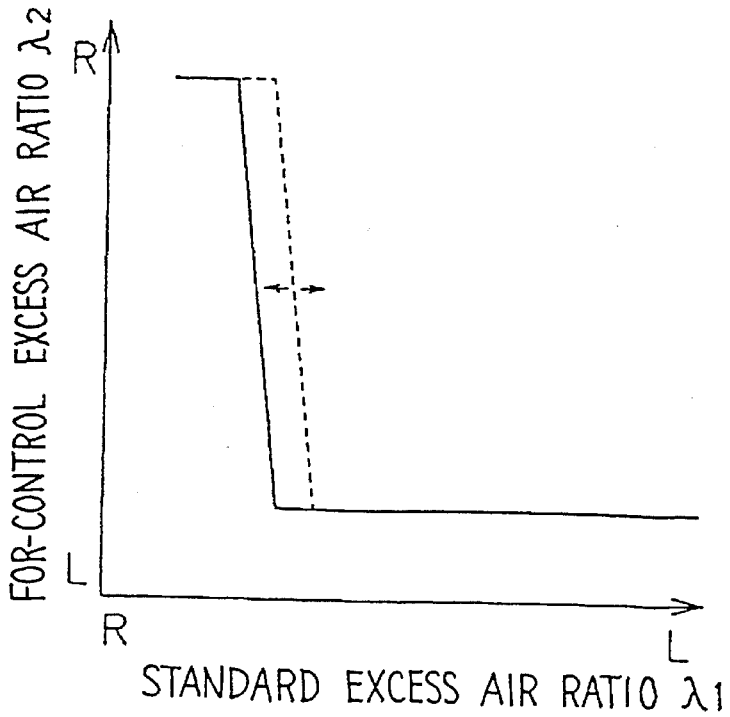
FIG. 20 is a graph for explaining a correction characteristic of the correction linearizer.

Further, when the characteristic of the correction linearizer 51 is biased toward the LEAN side, as identified by the lower dotted line in FIG. 6B, such a biased characteristic of the correction linearizer 51 may be further corrected toward the RICH or LEAN side based on the correction amount $d^{\lambda}_{Y}$, as indicated by an arrow in FIG. 20 where the before-correction characteristic is a dotted line and the after-correction characteristic is a solid line.

Figure 21:
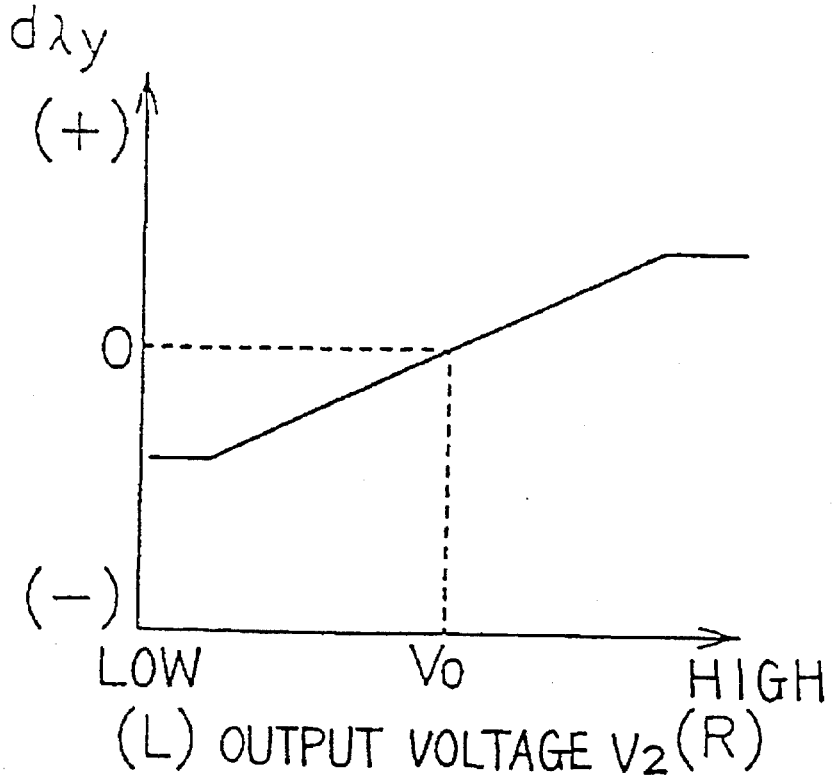
FIG. 21 is a characteristic map showing a relation between the output voltage of the downstream oxygen sensor and the correction amount.

Further, the two maps of FIGS. 16 and 17 may be replaced by one map, as shown in FIG. 21. In FIG. 21, a relation between the output voltage V2 of the downstream oxygen sensor 119 and the correction amount $d^{\lambda}_{Y}$ is defined. When the map of FIG. 21 is used, a data volume to be pre-stored is reduced and the processing speed increases. In FIG. 21, V0 represents a value of the output voltage V2 of the downstream oxygen sensor 119 which corresponds to an oxygen concentration of the target air-fuel ratio.

Now, a third preferred embodiment of the air-fuel ratio control, according to the present invention, will be described with reference to FIGS. 22 and 23.

In the second preferred embodiment, the output voltage V2 of the downstream oxygen sensor 119 is reflected on the correction amount $d^{\lambda}_{Y}$ using the maps of FIGS. 16 and 17. In the third preferred embodiment, the output voltage V2 of the downstream oxygen sensor 119 is compared with a reference voltage V0 sensor corresponding to the target excess air ratio $^{\lambda}0$ to determine whether the air-fuel ratio is RICH or LEAN relative to the target air-fuel ratio. At the time of an inversion between RICH and LEAN the before-correction base value $^{\lambda}{}_{2B}$ is changed in a skipped or stepped manner, then the before-correction base value $^{\lambda}{}_{2B}$ is changed by a small amount, i.e. bit by bit until the next occurrence of inversion between RICH and LEAN.

Specifically, the output voltage V2 of the downstream oxygen sensor 119 is first compared with the output voltage V0, representing the target excess air ratio $^{\lambda}0$, to determine whether the air-fuel ratio is RICH or LEAN. At the time of an inversion from RICH to LEAN, a given amount $d^{\lambda}{}_{R}$ is subtracted as shown in the following equation (22):

$$^{\lambda}{}_{2M}={}^{\lambda}{}_{2B}-d^{\lambda}{}_{R} \tag{22}$$

Subsequently, a correction amount $^{\Delta\lambda}{}_{R}$ is subtracted until an inversion from LEAN to RICH, as shown in the following equation (23):

$$^{\lambda}{}_{2M}={}^{\lambda}{}_{2B}-d^{\lambda}{}_{R}-{}^{\Delta\lambda}{}_{R}\,t \tag{23}$$

At the time of an inversion from LEAN to RICH, a given amount $d^{\lambda}{}_{L}$ is added as shown in the following equation (24):

$$^{\lambda}{}_{2M}={}^{\lambda}{}_{2B}+d^{\lambda}{}_{L} \tag{24}$$

Subsequently, a correction amount $^{\Delta\lambda}{}_{L}$ is added until an inversion from RICH to LEAN, as shown in the following equation (25):

$$^{\lambda}{}_{2M}={}^{\lambda}{}_{2B}+d^{\lambda}{}_{L}+{}^{\Delta\lambda}{}_{L}\,t \tag{25}$$

The correction process represented by the equations (22) to (25) will be described in detail hereinbelow with reference to a flowchart of FIG. 22, which shows a second linearized characteristic correction routine.

The second linearized characteristic correction routine is for correcting the characteristic of the correction linearizer 51 represented by the solid line in FIG. 9 and is executed by the CPU 31*a* in ECU 30 as a timer interrupt per each cycle of 1 sec.

Through steps 301 to 305, it is checked whether a condition for executing the second linearized characteristic correction routine is established. Specifically, the first step checks whether a condition for the air-fuel ratio feedback control is established. Step 301 corresponds to step 100 in FIG. 3. If the answer at step 301 is NO, then the routine ends. If answer at step 301 is YES, i.e., the condition for the air-fuel ratio feedback control is established, then the routine goes to step 303 where an engine coolant temperature is compared with a given value such as 70° C. If answer at step 303 is NO, i.e., the engine coolant temperature is no more than the given value (THW≦70° C.), then the routine ends. If answer at step 303 is YES (THW >70° C.) then step 305 checks whether the idle switch 15*b* is OFF, i.e. whether the throttle valve 9 is not fully closed. If answer at step 305 is NO, i.e. the idle switch in ON (LL=1), then the routine ends. When the answer at steps 301, 303 or 305 is NO routine end and the characteristic of the correction linearizer 51 is held unchanged. If the answer at step 305 is YES, i.e. the idle switch if OFF (LL=0), then the characteristic of the correction linearizer 51 is corrected through steps 307 to 337 based on the output voltage V2 of the downstream oxygen sensor 119.

Specifically, in steps 307 and 313, it is determined, based on the output voltage V2 of the downstream oxygen sensor 119, whether the air-fuel ratio is RICH or LEAN. Subsequently, in steps 315 to 319, a correction amount $^{\Delta}$RS is derived. In steps 321 to 333, a coordinate value $^{\Delta}$C of the for-control excess air ratio $^{\lambda}2$ is corrected based on the derived correction amount $^{\Delta}$RS. The coordinate value $^{\Delta}$C corresponds to the standard excess air ratio $^{\lambda}1$, being 1.0, i.e. the stoichiometric air-fuel ratio in the characteristic map of FIG. 9. Subsequently, in steps 335 or 337, the characteristic of the correction linearizer 51 is corrected based on the corrected value $^{\Delta}$C.

Referring back to step 307, the CPU 31*a* reads the output voltage V2 of the downstream oxygen sensor 119 via the A/D converter 41. Subsequently, step 309 compares the read-out output voltage V2 with a reference voltage V0 to determine whether the monitored air-fuel ratio is RICH or LEAN. If V2≦V0 (LEAN), a flag F2 is reset to 0. On the other hand, if V2>V0, then the flag F2 is set to 1. Subsequently, the routine goes to step 315, which determines whether the flag F2 has been inverted at step 311 or 313. If the answer at step 315 is YES, i.e. the flag F2 has been inverted, then step 317 reads engine speed N based on an output signal from the engine speed sensor 25 and further derives, by interpolation, the correction amount $^{\Delta}$RS based on the engine speed N using a pre-stored one dimensional map. The engine speed N represents an engine parameter which indicates the exhaust gas delay. Accordingly, in the pre-stored one dimensional map, the correction amount $^{\Delta}$RS decreases corresponds to an increase of the engine speed N. Specifically, when the engine speed N increases to reduce the exhaust gas transfer delay during engine high load driving, the correction amount $^{\Delta}$RS is set to a small value. On the other hand, when the engine speed N decreases to increase the exhaust gas transfer delay during engine low load driving, the correction amount $^{\Delta}$RS is set to a large value.

If the answer at step 315 is NO, i.e. no inversion of the flag F2 has occurred at step 311 or 313, then the routine goes to step 319 where the correction amount $^{\Delta}$RS is set to a fixed amount $^{\Delta}$RSj which is far smaller than the correction amount $^{\Delta}$RS at step 317.

The routine then goes to step 321 which checks whether the flag F2 is 0, i.e. whether the monitored air-fuel ratio is LEAN. If the answer at step 321 is YES, a new value of $^{\lambda}$C is derived by subtracting the correction value $^{\Delta}$RS, derived at the step 317 or 319 from a current value of $^{\lambda}$C, which was derived in the last cycle of this routine. At the subsequent step 327, the new value $^{\lambda}$C is compared with a preset minimum value. If the answer at step 327 is YES, i.e. the new value $^{\lambda}$C is less the preset minimum value, the new value $^{\lambda}$C is set to the preset minimum value at step 329. Subsequently, the routine goes to step 335. On the other hand, if the answer at step 327 is NO, i.e. the new value $^{\lambda}$C is no less than the preset minimum value, the routine goes to step 335. At step 335 the characteristic map of the correction linearizer 51 is updated based on the new value $^{\lambda}$C derived at step 323 or 329. Specifically, as in the second preferred embodiment, the X-Y coordinate position ($^{\lambda}1$, $^{\lambda}2$)=(1.0, $^{\lambda}$C) is updated by the new $^{\lambda}$, and subsequently a new X-Y coordinate position (1.0, new $^{\lambda}$C) is connected to the RICH side end point A and the LEAN side end point B by respective lines.

Referring back to step 321, if the answer at the step 321 is NO, i.e. the monitored air-fuel ratio is RICH, then the routine goes to step 325 where a new $^{\lambda}$C is derived by adding the correction value $^{\Delta}$RS to the value $^{\lambda}$C, which was derived in the last cycle of this routine. At step 331, the new $^{\lambda}$C is compared with a preset maximum value. If the answer at step 331 is YES, i.e. the new $^{\lambda}$ is larger than the preset maximum value, the new $^{\lambda}C$ is set to the preset maximum value at step 333. Thereafter, the routine goes to step 337. On the other hand, if the answer at the step 331 is NO, i.e. the new $^{\lambda}C$ is no larger than the preset maximum value, the routine goes to step 337. At step 337, the characteristic map of the correction linearizer 51 is updated in the same manner as at step 335.

The preset minimum value at step 327 is determined so as to not spoil the follow-up characteristic of the control under an engine transitional condition. On the other hand, the preset maximum value is determined not to deteriorate the driving performance due to variations in the air-fuel ratio.

After the characteristic of the correction linearizer 51 is updated at step 335 or 337, the second linearized characteristic correction routine is ended and the air-fuel ratio feedback control is performed based on the updated characteristic of the correction linearizer 51 as in the foregoing first and second preferred embodiments.

Figure 22:
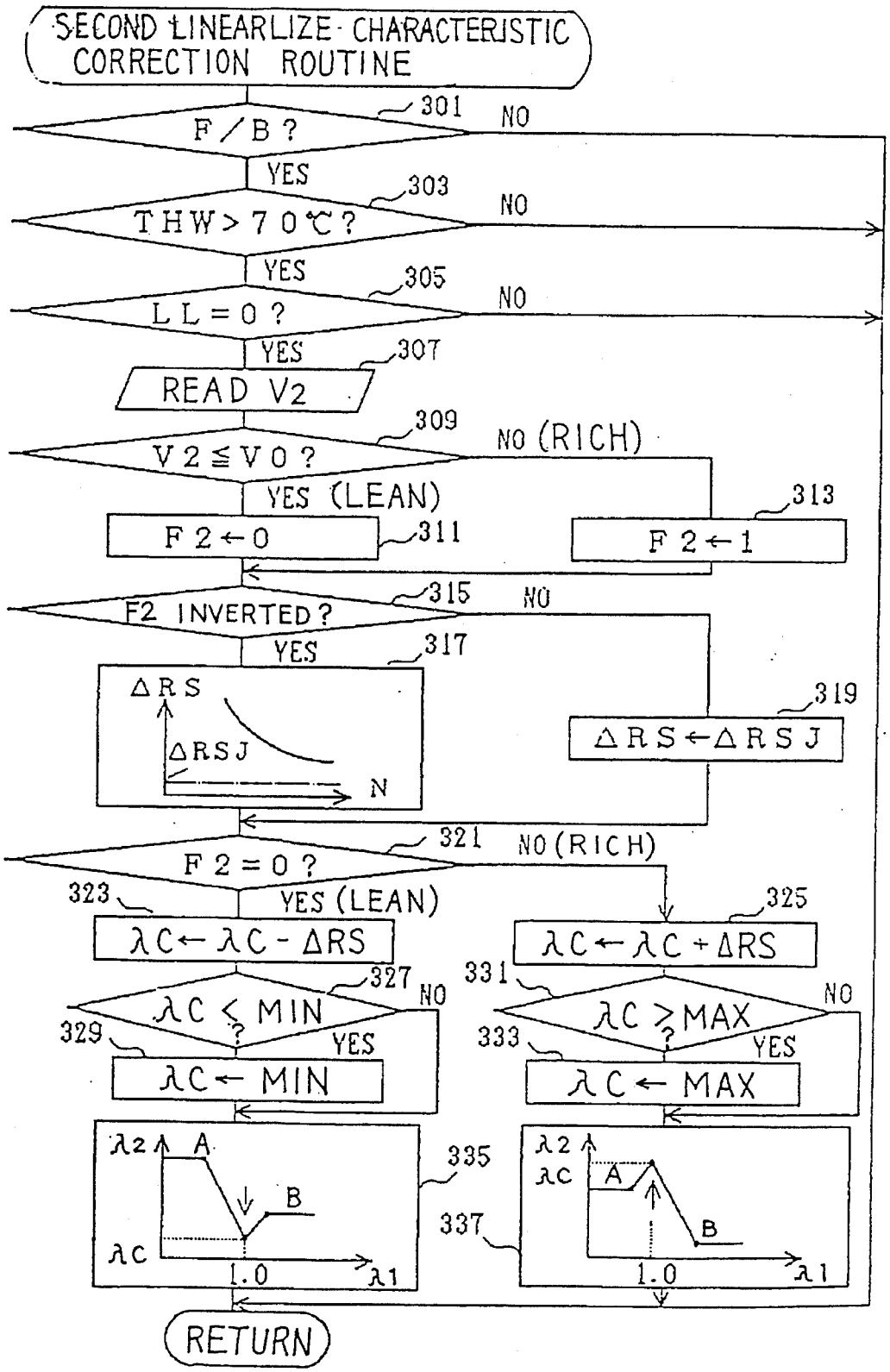
FIG. 22 is a flowchart of a second linearized characteristic correction routine according to a third preferred embodiment of the present invention.
Figure 23:
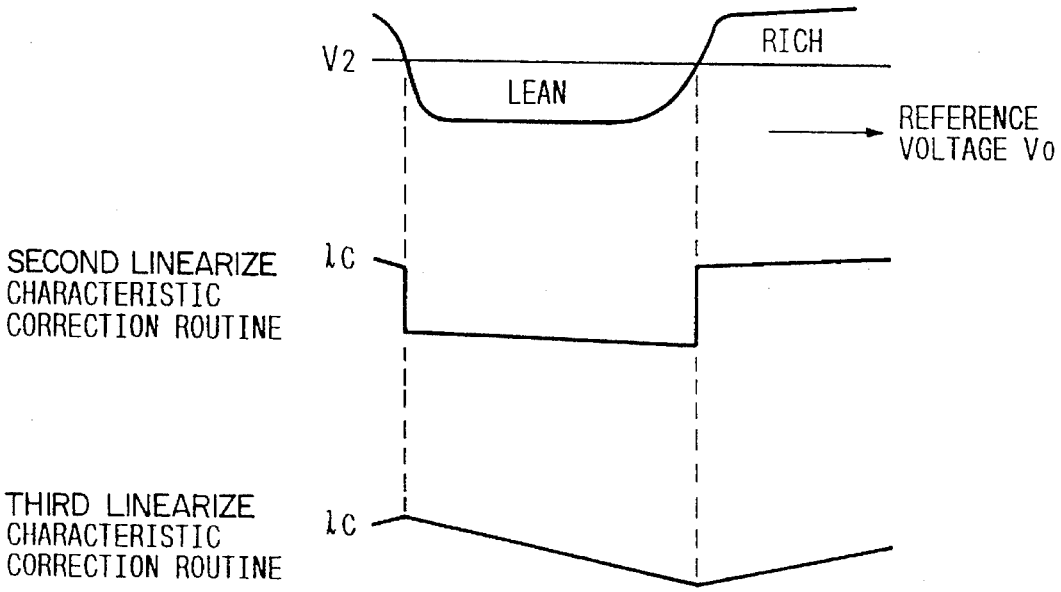
FIG. 23 is a timing chart showing effects realized by the second linearized characteristic correction routine and a third linearized characteristic correction routine, relative to time-domain variations in the output of the downstream oxygen sensor.

As shown in FIG. 23, time-domain variations of the value $^{\lambda}C$, corrected by the second linearized characteristic correction routine of FIG. 22, substantially correspond to time-domain variations of the output voltage V2 of the downstream oxygen sensor 119. Accordingly, the third preferred embodiment enables the center of the air-fuel ratio feedback control to follow the target air-fuel ratio as in the second preferred embodiment.

Further, in the third preferred embodiment, since the correction amount $^{\Delta}RS$ is derived based on the monitored engine speed N, which indicates the exhaust gas transfer delay, the response characteristic of the downstream oxygen sensor 119 is improved on a practical basis. The engine speed N may be replaced by another engine load indicating parameter such as a monitored intake air amount or a monitored intake vacuum pressure for deriving the correction amount $^{\Delta}RS$. Further, the pre-stored one dimensional map used at the step 317 may be replaced by a two dimensional map that defines the correction amount $^{\Delta}RS$ in terms of the engine speed and the intake air amount or the intake vacuum pressure.

Figure 24:
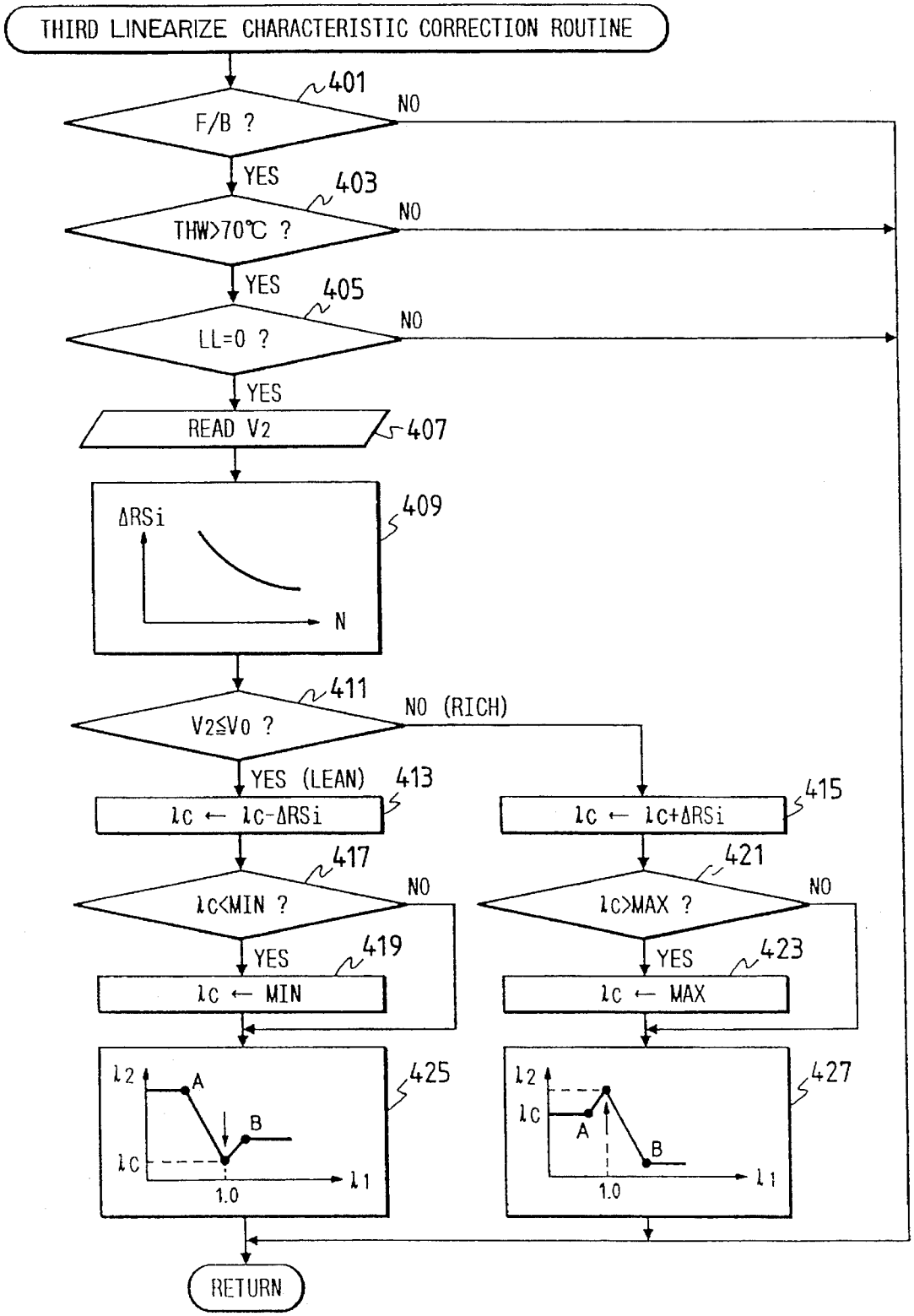
FIG. 24 is a flowchart of the third linearized characteristic correction routine which is a modification of the second linearized characteristic correction routine.

FIG. 24 shows a third linearized characteristic correction routine, which is a modification of the third preferred embodiment.

In the second linearized characteristic correction routine of FIG. 22, the value $^{\lambda}C$ is changed in a skipped manner at the inversion between RICH and LEAN and is thereafter changed per a fixed small amount until a next occurrence of the inversion between RICH and LEAN. On the other hand, in the third correction routine of FIG. 24, a correction amount $^{\Delta}RSi$ is derived based on an engine parameter, such as engine speed N, which indicates the exhaust gas transfer delay, and the value $^{\lambda}C$ is corrected by subtracting the correction amount $^{\Delta}RSi$ therefrom during execution of the correction routine when the monitored air-fuel ratio is LEAN and by adding a correction amount $^{\Delta}RSi$ thereto per execution cycle of the correction routine when the monitored air-fuel ratio is RICH.

Steps 401 to 407 correspond to steps 301 to 307 in FIG. 22. At subsequent step 409, the correction amount $^{\Delta}RSi$ is derived by interpolation based on the engine speed N using a pre-stored one dimensional map, which defines a relation between the engine speed N and the correction amount $^{\Delta}RSi$. In the map at step 409, the correction amount $^{\Delta}RSi$ is set to decrease in response to an increase of engine speed N as in the map at step 317 in FIG. 22. Step 411 corresponds to step 309 in FIG. 22 and determines whether the monitored air-fuel ratio is RICH or LEAN. If LEAN is determined at step 411, the characteristic map of the correction linearizer 51 is corrected through steps 413,417, 419 and 425, which respectively correspond to steps 323, 327, 329 and 335 in FIG. 22. On the other hand, if RICH is determined at step 411, the characteristic map of the correction linearizer 51 is corrected through steps 415, 421, 423 and 427 which respectively correspond to the steps 325, 331, 333 and 337 in FIG. 22.

As shown in FIG. 23, time-domain variations of the value $^{\lambda}C$, corrected by the third correction routine of FIG. 24, correspond to time-domain variations of the output voltage V2 of the downstream oxygen sensor 119 as in the case of the second correction routine of FIG. 22. Accordingly, in this modification of the third preferred embodiment, the center of the air-fuel ratio feedback control is delicately adjusted to follow the target air-fuel ratio via a simpler process. Since the correction amount $^{\Delta}RSi$ is derived based on the monitored engine speed N, the response characteristic of the downstream oxygen sensor 119 is improved on a practical basis also in the third correction routine of FIG. 24.

Further, as in the second correction routine of FIG. 22, the one dimensional map at the step 409 may be replaced by a two dimensional map, which defines the correction amount $^{\Delta}RSi$ in terms of engine speed, and intake vacuum pressure or intake air quantity.

Further, in the first preferred embodiment and in the first to third linearized characteristic correction routines, the oxygen sensors 19 and 119 may be replaced by any sensor such as a CO sensor and a lean mixture sensor as long as it detects a concentration of a particular component contained in the exhaust gas so as to monitor the air-fuel ratio of the exhaust gas.

Further, through the biased characteristic of the correction linearizer 51 of the first preferred embodiment is further corrected in the first to third correction routines of FIGS. 15, 22 and 24, such a further corrected characteristic of the correction linearizer 51 is prepared beforehand based on the output voltage V2 of the downstream oxygen sensor 119 and pre-stored in RAM. Specifically, when finally setting the characteristic of the correction linearizer 51, the engine is operated under a non-idling condition so as to correct and bias the characteristic of the correction linearizer 51 identified by the solid line in FIG. 6A or 6B toward the RICH or LEAN side within the given air-fuel ratio range of the standard excess air ratio $^{\lambda}1$ based on the detected output voltage V2 of the downstream oxygen sensor 119. This biased characteristic of the correction linearizer 51 is pre-stored in the RAM. This biasing correction of the characteristic of the correction linearizer 51 is easily performed by using one of the first to third correction routines.

For example, when the first correction routine of FIG. 15 is used, the for-control excess air ratio $^{\lambda}2$, corresponding to a value 1.0 of the standard excess air ratio $^{\lambda}1$ in the non-biased characteristic of the correction linearizer 51 as identified by the solid line in FIG. 6A, is set as the before-correction base value $^{\lambda}{}_{2B}$. Subsequently, the after-correction base value $^{\lambda}{}_{2B}$ is derived by adding the correction amount $d^{\lambda}{}_{Y}$ based on the output voltage V2 to the before-correction base value $^{\lambda}{}_{2B}$. Thereafter, the lines are drawn from the new X-Y coordinate position (1.0, $^{\lambda}{}_{2M}$) to the RICH and LEAN side end points A and B respectively so as to bias or shift the non-biased characteristic of the correction linearizer 51 toward the RICH or LEAN side as shown by one of the dotted lines in FIG. 6A.

Further explanation regarding biasing the non-biasing characteristic of the correction linearizer 51 with reference to FIG. 6B, using the first correction routine of FIG. 15 will now be made.

In the non-biased characteristic of the correction linearizer 51 identified by the solid line in FIG. 6B, one of the points A and B is held fixed and the other of the points A and B is displaced along the X-axis, i.e. the axis for the standard excess air ratio $^{\lambda}1$. For example, when biasing the characteristic toward the LEAN side, point A is held fixed and only an X-coordinate of point B is displaced toward the Y-axis by an amount corresponding to the correction amount $d^{\lambda}_{Y}$ so as to obtain a point B1. The biased characteristic of the correction linearizer 51 is attained by connecting point B1 to point B and to point A respectively. When biasing the characteristic of the correction linearizer 51 toward the RICH side, point B is held fixed and only an X-coordinate of point A is displaced away from the Y-axis by an amount corresponding to the correction amount $d^{\lambda}_{Y}$ so as to obtain a point A1. The biased characteristic of the correction linearizer 51 is attained by connecting the point A1 to point A and to point B respectively. Obviously, the displacement may also be made in a B1-to-B direction or in a A1-to-A direction.

Still further, when the second or third correction routine of FIGS. 22 or 24 is used, a negative value of the correction amount $^{\Delta}$RS or $^{\Delta}$RSi is used, instead of the correction amount $d^{\lambda}_{Y}$, when the monitored air-fuel ratio is LEAN. A positive value of the correction amount $^{\Delta}$RS or $^{\Delta}$RSi is used, instead of the correction amount $d^{\lambda}_{Y}$, when the monitored air-fuel ratio is RICH. The subsequent process is the same as in the foregoing case where the first correction routine is used.

Further, though the value $^{\lambda}$C represents a Y-coordinate corresponding to an X-coordinate 1.0 of the standard excess air ratio $^{\lambda}1$, i.e. the stoichiometric air-fuel ratio in the first to third correction routines, the value $^{\lambda}$C may represent a Y-coordinate corresponding to an X-coordinate other than 1.0, i.e. other than a standard excess air ratio $^{\lambda}1$ corresponding to the stoichiometric air-fuel ratio. In other words, the value $^{\lambda}$C may correspond to the standard excess air ratio $^{\lambda}1$, which corresponds to a target excess air ratio $^{\lambda}0$, other than the stoichiometric air-fuel ratio.

Now, a fourth preferred embodiment of the air-fuel ratio control system according to the present invention will be described with reference to FIGS. 25 to 32.

In the fourth preferred embodiment, an output voltage VOX of the upstream oxygen sensor 19 is compared with a reference voltage VR to determine whether a monitored air-fuel ratio is RICH or LEAN. Based on this determination, a feedback air-fuel ratio dependent correction coefficient FAF is calculated using given control constants such as delay times, skip amounts and integral constants. The air-fuel ratio feedback control is performed based on this calculated FAF, wherein preselected control constants are corrected using a correction amount $^{\Delta}$RSy, which is derived depending on a magnitude of the output voltage V2 of the downstream oxygen sensor 119.

Figure 25:
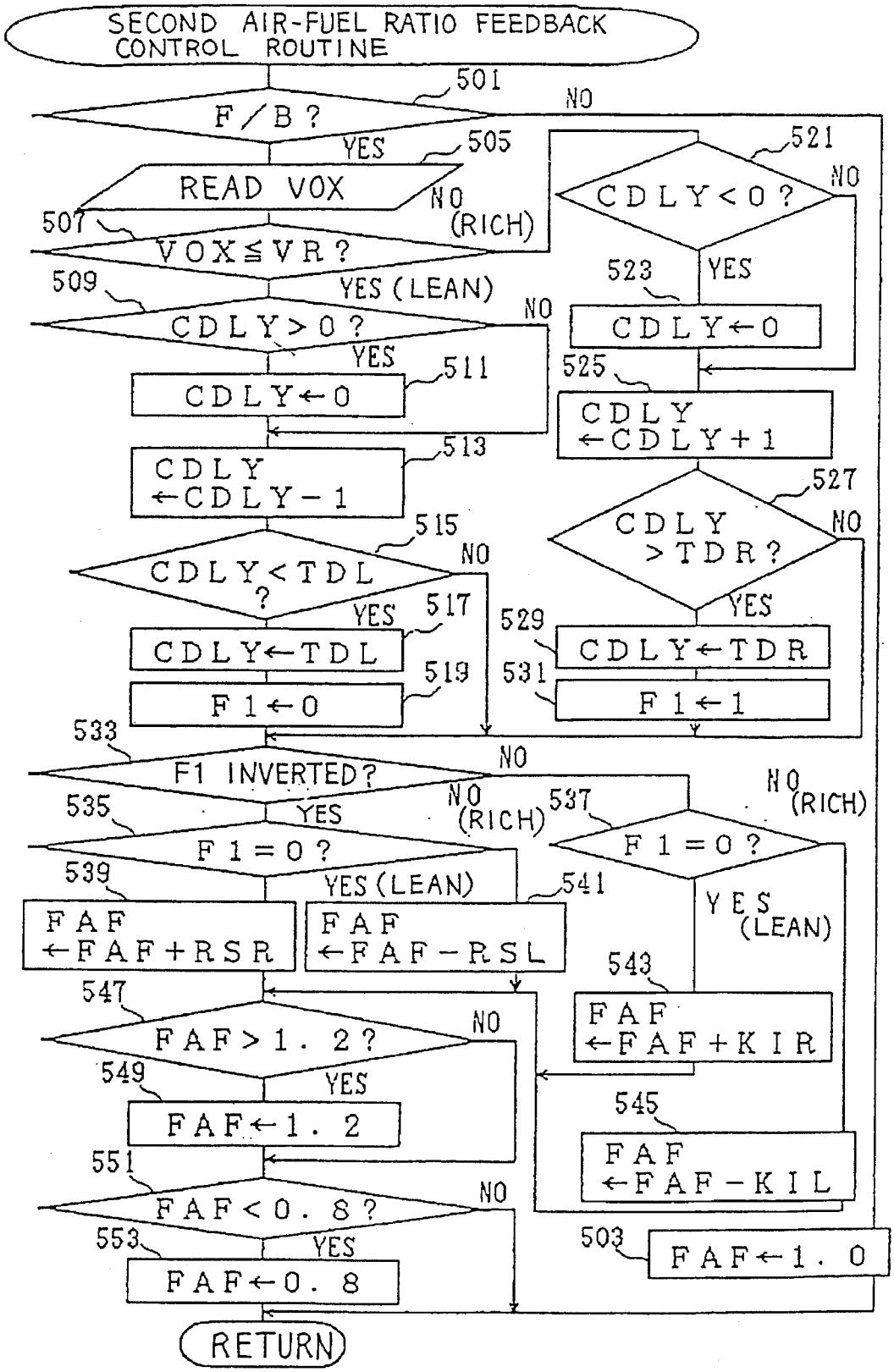
FIG. 25 is a flowchart showing a second air-fuel ratio feedback control routine.

FIG. 25 shows a second air-fuel ratio feedback control routine for calculating the air-fuel ratio dependent correction coefficient FAF based on the given control constants, i.e. delay times TDR, TDL, skip amounts RSR, RSL, integral constants KIR, KIL, using a RICH/LEAN determination based on the output voltage VOX of the upstream oxygen sensor 19. This feedback routine is executed by the CPU 31*a* in the ECU 30 as a timer interrupt each cycle of 4 msec.

Specifically, at the first step 501, it is determined whether a predetermined condition for executing the air-fuel ratio feedback control is established. If the answer at step 501 is YES, i.e. the condition for the air-fuel ratio feedback control is established, the routine goes to step 505 where an output voltage VOX of the upstream oxygen sensor 19 is read. Subsequently, at step 507, the output voltage VOX is compared with a reference voltage VR to determine whether a monitored actual air-fuel ratio is RICH or LEAN with respect to a target air-fuel ratio. If the answer at step 507 is YES, i.e. LEAN is determined, then the routine goes through steps 509 to 519. Through steps 509 to 519, a delay counter CDLY is counted down by one (step 513), and when the value of the delay counter CDLY becomes less than a preset minimum value TDL, a flag F1 is set to zero indicating that the air-fuel ratio is LEAN. On the other hand, if the answer at step 507 is NO, i.e. RICH is determined, then the routine goes through steps 521 to 531. Through steps 521 to 531, the delay counter CDLY is counted up by one (step 525), and when the value of the delay counter CDLY becomes larger than a preset maximum value TDR, the flag F1 is set to 1 indicating that the air-fuel ratio is RICH. Accordingly, through steps 509 to 531, a detection of an inversion from RICH to LEAN is delayed by a delay time determined by the preset minimum value TDL, and a detection of an inversion from LEAN to RICH is delayed by a delay time determined by the preset maximum value TDR. This is done in comparison with the detection thereof at the step 507. As a result, the RICH/LEAN determination as well as the detection of the inversion between RICH and LEAN based on the condition of the flag F1 becomes more reliable. In addition, by adjusting the preset maximum and minimum values TDR and TDL, the center of the air-fuel ratio feedback control is delicately adjusted toward the RICH side or the LEAN side.

Subsequently, at a step 533, it is checked whether the flag F1 is inverted between RICH and LEAN. If step 533 determines the inversion of the flag F1, step 535 determines whether the flag F1 is set to zero. If the answer at step 535 is YES, i.e. LEAN is determined, then a rich skip amount RSR is added to the feedback air-fuel ratio dependent correction coefficient FAF in a skipped manner at step 539. On the other hand, if RICH is determined at step 535, a lean skip amount RSL is subtracted from the coefficient FAF in a skipped manner at step 541. If no inversion between RICH and LEAN is determined at step 533, step 537 checks whether the flag F1 is set to zero. If the answer at step 537 is YES, i.e. LEAN is determined, then a rich integral constant KIR is added to the coefficient FAF at step 543. On the other hand, if RICH is determined at step 537, then a lean integral constant KIL is subtracted from the coefficient FAF at step 545.

Through steps 547 to 553, the coefficient FAF is controlled to a value between a maximum value of 1.2 and a minimum value of 0.8. Referring back to step 501, if the answer at step 501 is NO, i.e. the condition for the air-fuel ratio feedback control is not established, the routine goes to step 503 where the coefficient FAF is set to 1.0, and is ended.

Figure 26:
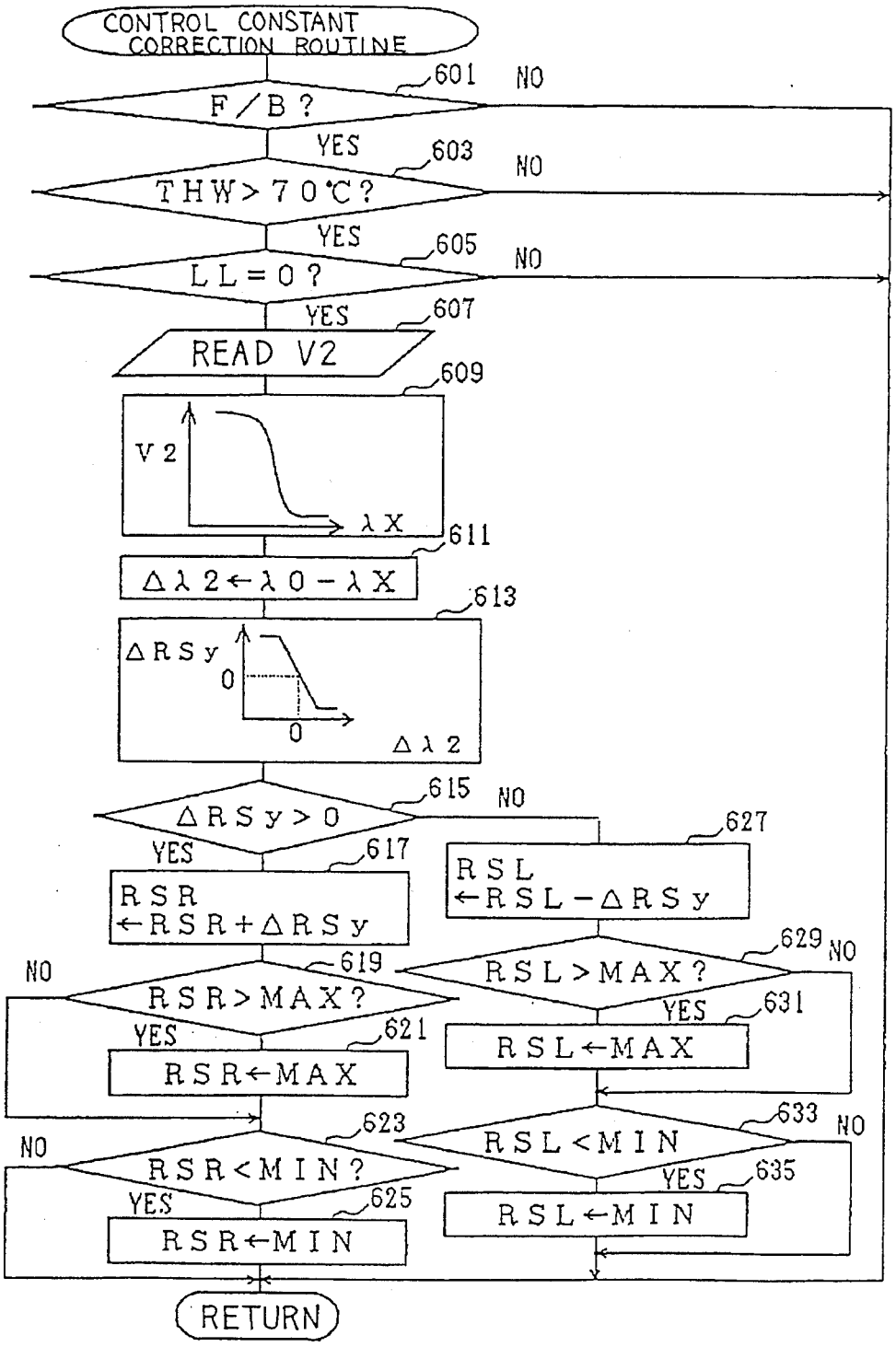
FIG. 26 is a flowchart showing a control constant correction routine cooperative with the second air-fuel ratio feedback control routine of FIG. 25, according to a fourth preferred embodiment of the present invention.

FIG. 26 shows a control constant correction routine for correcting the rich and lean skip amounts RSR and RSL based on the output voltage V2 of the downstream oxygen sensor 119. This correction routine is executed as a timer interrupt per cycle longer than that of the second air-fuel ratio feedback control routine in FIG. 25, for example, per 150 msec.

Figure 27:
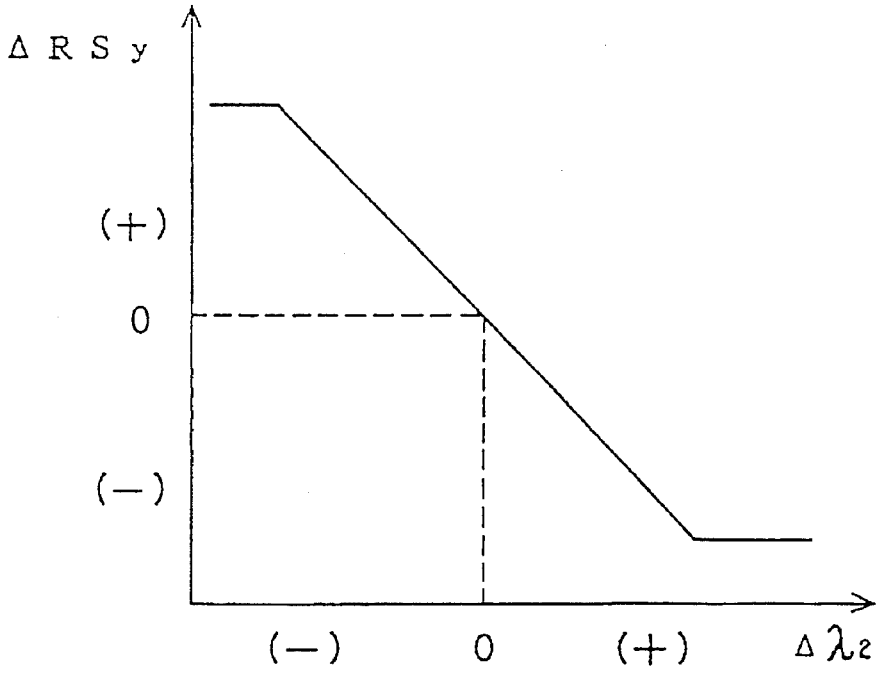
FIG. 27 is a characteristic map showing a relation between a deviation and a correction amount in the fourth preferred embodiment.

Steps 601 to 607 respectively correspond to the steps 301 to 307 in the second linearized characteristic correction routine in FIG. 22. At a subsequent step 609, an actual excess air ratio $^{\lambda}$x is derived based on the output voltage V2 using a pre-stored map. At step 611, a deviation $^{\Delta\lambda}2$ is calculated by subtracting the derived actual excess air ratio $^{\lambda}$x from a target excess air ratio $^{\lambda}0$ and stored in the RAM 31*c*. Subsequently, at step 613, a correction amount $^{\Delta}$RSy is derived based on the stored deviation $^{\Delta\lambda}2$ using a pre-stored map which defines a relation between the deviation $^{\Delta\lambda}2$ and the correction amount $^{\Delta}$RSy. As shown in FIG. 27, in this pre-stored map, the correction amount $^{\Delta}$RSy is in inverse proportion to the deviation $^{\Delta\lambda}2$ within a given range across the deviation $^{\Delta\lambda}2$, being a value of zero. Specifically, this given range comprises the same width range on each side with respect to the deviation $^{\Delta\lambda}2$ being zero. On the other hand, the correction amount $^{\Delta}$RSy is held constant outside the above-noted given range.

Accordingly, for example, when an oxygen concentration in the exhaust gas downstream of the catalytic converter 118 becomes higher (LEAN) than that of the target excess air ratio $^{\lambda}0$, the output voltage V2 of the downstream oxygen sensor 119 decreases in order to increase the excess air ratio $^{\lambda}x$ so that the deviation $^{\Delta\lambda}2$ becomes a negative value. As a result, the correction amount $^{\Delta}$RSy becomes a positive value as seen from FIG. 27. On the other hand, when the oxygen concentration in the exhaust gas downstream of the catalytic converter 119 becomes less (RICH) than that of the target excess air ratio $^{\lambda}0$, then the correction amount $^{\Delta}$RSy becomes a negative value.

Subsequently, step 615 determines whether the correction amount $^{\Delta}$RSy is larger than zero. If the answer at the step 615 is YES (LEAN), the routine goes to step 617 where the rich skip amount RSR is corrected by adding the correction amount $^{\Delta}$RSy thereto. Through steps 619 to 625, the corrected rich skip amount RSR is controlled to a value between the preset maximum and minimum values. On the other hand, if the answer at step 615 is NO (RICH), then the routine goes to step 627 where the lean skip amount RSL is corrected by subtracting the correction amount $^{\Delta}$RSy therefrom. Through steps 629 to 635, the corrected lean skip amount RSL is controlled to a value between preset maximum and minimum values. When the step 625 or 635 is executed, this interrupted routine is ended.

Based on the corrected skip amount RSR or RSL, the second air-fuel ratio feedback control routine of FIG. 25 is performed.

Figure 28:
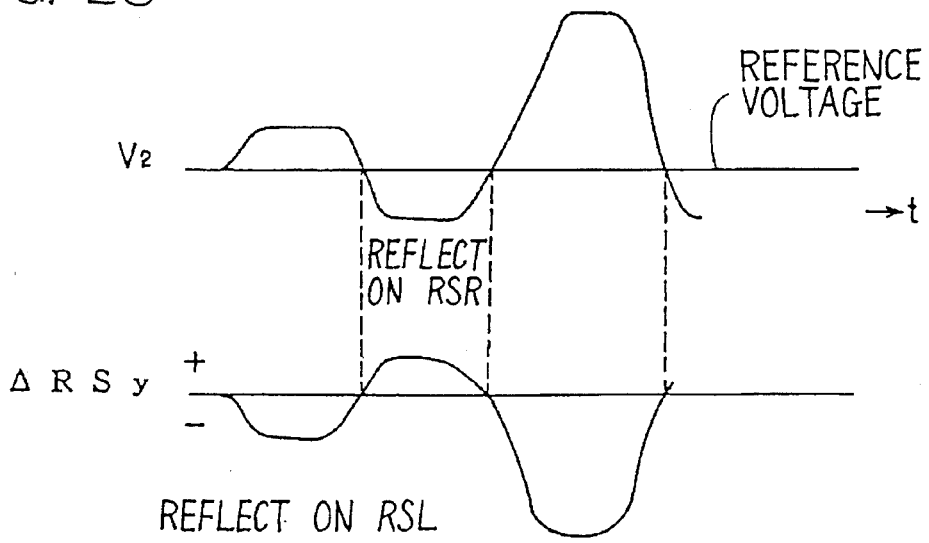
FIG. 28 is a timing chart showing a relation between the output of the downstream oxygen sensor and the correction amount.

Since the correction amount $^{\Delta}$RSy is variable depending on a magnitude of the output voltage V2 of the downstream oxygen sensor 119, not only the timing of an inversion between RICH and LEAN is determined by the output voltage V2, but also a degree of RICH or LEAN relative to the reference voltage, i.e. the deviation $^{\Delta\lambda}2$ are reflected on the time-domain characteristic of the correction amount $^{\Delta}$RSy as shown in FIG. 28. Accordingly, as shown in FIG. 29, since the skip amounts RSR and RSL are corrected by the correction amount $^{\Delta}$RSy, the deviation $^{\Delta\lambda}2$, i.e. the deviation of the actual excess air ratio relative to the target excess air ratio, is also reflected on the time-domain characteristics of the skip amounts RSR and RSL so that the deviation $^{\Delta\lambda}2$ is further reflected on the feedback correction coefficient FAF, which is derived based on the skip amount RSR or RSL. As a result, for example, even if the nature of the fuel is significantly changed to largely deviate the center of the air-fuel ratio feedback control, the deviation $^{\Delta\lambda}2$, which corresponds to a sudden deviation of the control center, is reflected on the feedback correction coefficient FAF. Accordingly, the air-fuel ratio feed back control based on the correction coefficient FAF enables the center of the air-fuel ratio control to follow up the target air-fuel ratio immediately. It is to be noted that reference values for the skip amounts RSR and RSL in FIG. 29 respectively represent values of the skip amounts RSR and RSL before the correction by the correction amount $^{\Delta}$RSy.

Figures 31A, 31B, 31C, 31D, 31E, 31F:
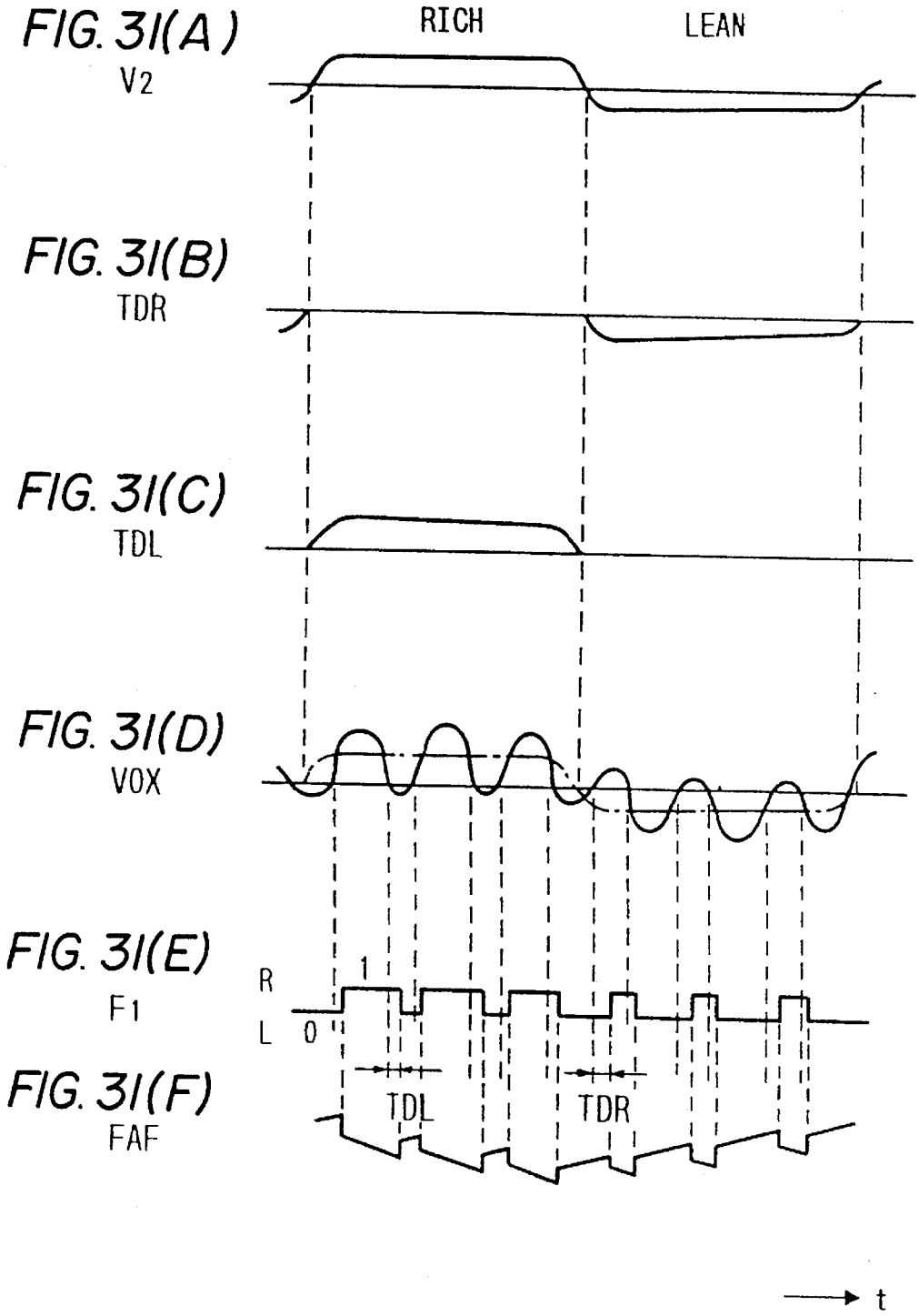
FIG. 31 is a timing chart showing time-domain relation between the output of the downstream oxygen sensor, delay times, the output of the upstream oxygen sensor, a condition of a flag and the feedback air-fuel ratio dependent correction coefficient.

Instead of the skip amounts RSR and RSL, the integral constants KIR and KIL or the delay times TDR and TDL may be corrected based on the correction amount $^{\Delta}$RSy in the same manner as for the correction of the skip amounts RSR and RSL. In this case, as shown in FIGS. 30 and 31, the deviation of the output voltage V2 relative to the reference voltage, i.e. the deviation $^{\Delta\lambda}2$ is also reflected on the time-domain characteristics of the integral constants KIR, KIL and the delay times TDR, TDL. As a result, the deviation $^{\Delta\lambda}2$ is finally reflected on the correction coefficient FAF as in the case of the correction of the skip amounts RSR and RSL.

When the skip amounts RSR, RSL are corrected based on the correction amount $^{\Delta}$RSy, the high follow-up controllability of the air-fuel ratio is ensured. When the integral constants KIR and KIL are corrected based on the correction amount $^{\Delta}$RSy, the simple process is a result. When the delay times TDR and TDL are corrected based on the correction amount $^{\Delta}$RSy, delicate adjustments of the air-fuel ratio are ensured. Further, more than one of the corrected skip amounts, the corrected integral constants and the corrected delay times may be used for calculating the feedback correction coefficients FAF. Still further, one of the skip amounts RSR and RSL may be held fixed while the other is corrected. Similarly, one of the integral constants KIR and KIL or one of the delay times TDR and TDL may be held fixed and only the other thereof may be corrected.

Figure 32:
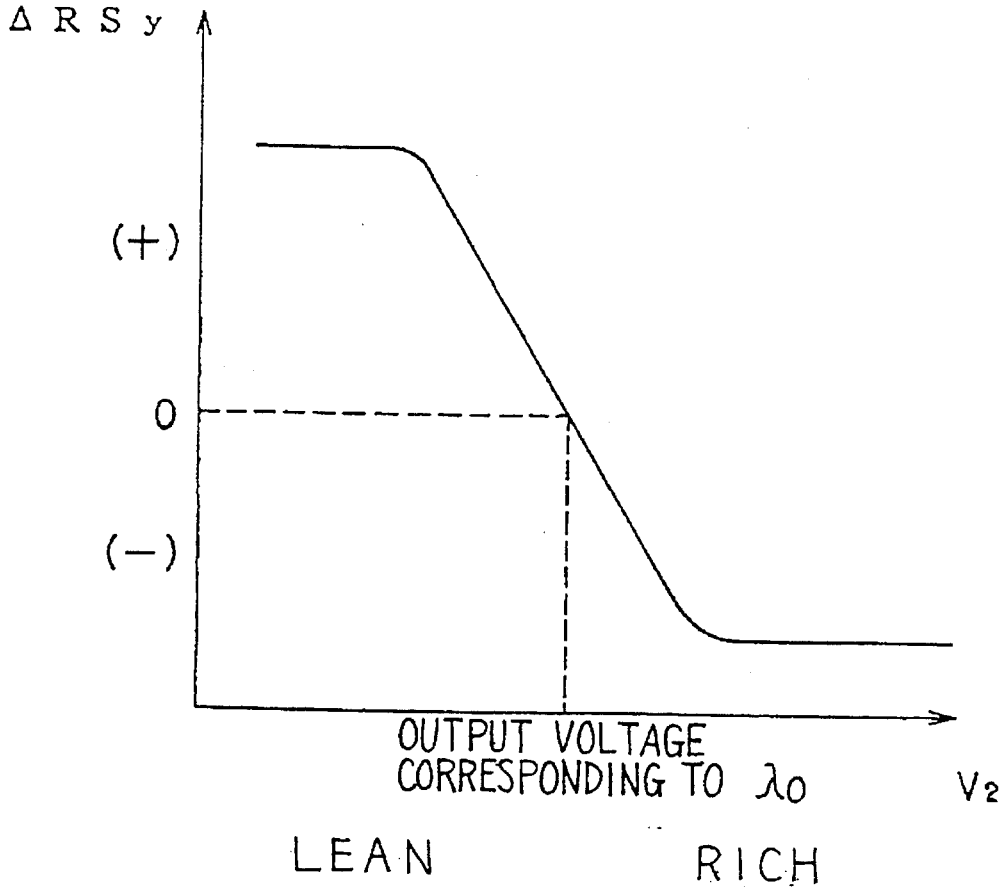
FIG. 32 is a characteristic map showing a relation between the output of the downstream oxygen sensor and the correction amount.

The two maps respectively used at the steps 609 and 613 may be replaced by one map as shown in FIG. 32, which directly defines a relation between the output voltage V2 and the correction amount $^{\Delta}$RSy. This reduces a volume of the data to be stored, and increases the processing speed.

Further, the oxygen sensors 19 and 119 may be replaced by a CO sensor and a lean mixture sensor as in the foregoing preferred embodiments.

It is to be understood that this invention is not to be limited to the preferred embodiments and modifications described above, and the various changes and modifications may be made without departing from the spirit and scope of the invention as defined in the appended claims. For example, though the internal combustion engine is described as being of a fuel injection type in the foregoing description, the present invention is also applicable to the internal combustion engine of a carburetor type. Further, though the air-fuel ratio feedback control is performed using the microcomputer in the foregoing description, this may also be performed using an analog circuit.

What is claimed is:

1. An air-fuel ratio control system for an internal combustion engine, comprising:

a catalytic converter;

a first sensor, positioned upstream of said catalytic converter, for producing a first air-fuel indicative signal based on a preselected component which is contained in an exhaust gas upstream of said catalytic converter;

a second sensor, positioned downstream of said catalytic converter, for producing a second air-fuel indicative signal based on a preselected component which is contained in an exhaust gas downstream of said catalytic converter;

determining means for comparing said first air-fuel indicative signal with a reference value and for generating an output signal based on said comparison indicating whether an input air-fuel ratio of a gas mixture to be fed into an engine cylinder of said internal combustion engine is rich or lean relative to a target air-fuel ratio;

control means for performing a feedback control of said input air-fuel ratio based on a feedback control constant and said output signal generated by said determining means;

deriving means for deriving a correction amount for said feedback control constant based on a deviation of said second air-fuel indicative signal relative to a target air-fuel ratio indicative value; and correction means for correcting said feedback control constant based on said derived correction amount, wherein said correction amount changes in sign between a first sign and a second sign when said second air-fuel indicative signal changes between a rich value and a lean value relative to said target air-fuel ratio indicative value, said second sign being opposite said first sign, and wherein said feedback control constant is one of a first feedback control constant and a second feedback control constant, said first feedback control constant being corrected by said correction amount when said correction amount has said first sign and being used by said control means to make said first air-fuel ratio richer, and said second feedback control constant being corrected by said correction amount when said correction amount has said second sign and being used by said control means to make said first air-fuel ratio leaner.

2. The system as set forth in claim 1, wherein said feedback control constant is limited by a preset maximum value and a preset minimum value.

3. The system as set forth in claim 1, wherein said second sensor is an oxygen sensor, presenting a sudden change in output across a stoichiometric air-fuel ratio.

4. The system as set forth in claim 1, wherein said deriving means also:

linearizes said second air-fuel indicative signal produced by said second sensor; and derives said correction amount for said feedback control constant based on a deviation of said linearized second air-fuel indicative signal relative to said target air-fuel ratio indicative value.

5. An air-fuel ratio control system for an internal combustion engine, comprising:

a catalytic converter;

a first sensor, positioned upstream of said catalytic converter, for producing a first air-fuel indicative signal based on a preselected component which is contained in an exhaust gas upstream of said catalytic converter;

a second sensor, positioned downstream of said catalytic converter, for producing a second air-fuel indicative signal based on a preselected component which is contained in an exhaust gas downstream of said catalytic converter;

determining means for monitoring said first air-fuel indicative signal, for determining whether an input air-fuel ratio corresponding to a mixture of gas to be fed into an engine cylinder of said internal combustion engine is rich or lean relative to a target air-fuel ratio, and for generating an output signal based on said determination;

control means for adjusting said input air-fuel ratio based on said output signal, said control means using a first feedback control constant to make said air-fuel ratio richer and said control means using a second feedback control constant to make said air-fuel ratio leaner;

deriving means for determining whether said second air-fuel indicative signal represents a lean value or a rich value relative to a target air-fuel ratio indicative value and for deriving a correction amount to have a first sign when said second air-fuel indicative signal represents said lean value and a second sign, opposite to said first sign, when said second air-fuel indicative signal represents said rich value, wherein an absolute value of said correction amount increases as said second air-fuel indicative signal deviates more from said target air-fuel ratio indicative value within a given range across said target air-fuel ratio indicative value; and correction means for correcting said first feedback control constant using said correction amount when said second air-fuel indicative signal represents said lean value, and for correcting said second feedback control constant using said correction amount when said second air-fuel indicative signal represents said rich value.

6. The system as set forth in claim 5, wherein said correction amount is held constant outside said given range.

7. An air-fuel ratio control system for an internal combustion engine, comprising:

a catalytic converter;

a first sensor, positioned upstream of said catalytic converter, for producing a first air-fuel indicative signal based on a preselected component which is contained in an exhaust gas upstream of said catalytic converter;

a second sensor, positioned downstream of said catalytic converter, for producing a second air-fuel indicative signal based on a preselected component which is contained in an exhaust gas downstream of said catalytic converter;

determining means for monitoring said first air-fuel indicative signal, for determining whether an input air-fuel ratio corresponding to a mixture of gas to be fed into an engine cylinder of said internal combustion engine is rich or lean relative to a target air-fuel ratio, and for generating an output signal based on said determination, wherein said determining means includes additional determining means for determining one of a first condition and a second condition based on a comparison between said first air-fuel indicative signal and a reference value which is indicative of said target air-fuel ratio, said first condition indicating a rich air-fuel ratio and said second condition indicating a lean air-fuel ratio, said determining means further including means for delaying an amount of time required to make a determination of said air-fuel ratio being rich or lean when said determination of said additional determining means changes between said first and second conditions;

control means for adjusting said input air-fuel ratio based on said output signal, said control means using a first feedback control constant to make said air-fuel ratio richer and said control means using a second feedback control constant to make said air-fuel ratio leaner;

deriving means for determining whether said second air-fuel indicative signal represents a lean value or a rich value relative to a target air-fuel ratio indicative value and for deriving a correction amount based on said determination; and correction means for correcting said first feedback control constant using said correction amount when said second air-fuel indicative signal represents said lean value, and for correcting said second feedback control constant using said correction amount when said second air-fuel indicative signal represents said rich value.

8. The system as set forth in claim 7, wherein said delaying means delays determination of said air-fuel ratio being rich using a first delay time when said determination of said additional determining means changes from said second condition to said first condition, and wherein said delaying means delays determination of said air-fuel ratio being lean using a second delay time when said determination of said additional determining means changes from said first condition to said second condition.

* * * * *